US006715542B2

(12) United States Patent
Mullins

(10) Patent No.: US 6,715,542 B2
(45) Date of Patent: Apr. 6, 2004

(54) TUBULAR FILLING SYSTEM

(76) Inventor: Albert Augustus Mullins, 18706 Arcaro Glen Ct., Humble, TX (US) 77346

( * ) Notice: Subject to any disclaimer, the term of this patent is extended or adjusted under 35 U.S.C. 154(b) by 0 days.

(21) Appl. No.: 10/460,781

(22) Filed: Jun. 12, 2003

(65) Prior Publication Data

US 2003/0217843 A1 Nov. 27, 2003

Related U.S. Application Data

(62) Division of application No. 10/052,301, filed on Jan. 18, 2002, now Pat. No. 6,604,578, which is a division of application No. 09/638,809, filed on Aug. 14, 2000, now Pat. No. 6,415,862, which is a division of application No. 09/161,051, filed on Sep. 25, 1998, now Pat. No. 6,390,190.

(60) Provisional application No. 60/084,964, filed on May 11, 1998.

(51) Int. Cl.[7] ..... E21B 19/16; E21B 21/00

(52) U.S. Cl. ..... 166/90.1; 166/177.4; 294/86.25

(58) Field of Search ..... 166/90.1, 177.4, 166/77.4, 75.13; 294/86.25

(56) References Cited

U.S. PATENT DOCUMENTS

| | | | | |
|---|---|---|---|---|
| 1,367,156 A | | 2/1921 | Owen | 166/75.13 |
| 1,512,619 A | * | 10/1924 | MacClatchie | 166/75.13 |
| 1,529,607 A | | 3/1925 | McAlvay et al. | 285/338 |
| 1,662,311 A | | 3/1928 | Hamer | |
| 1,822,444 A | | 9/1931 | MacClatchie | 285/425 |
| 1,866,726 A | | 7/1932 | Santiago | |

(List continued on next page.)

FOREIGN PATENT DOCUMENTS

WO WO93/07358 4/1993

OTHER PUBLICATIONS

B.J. Hughes Brochure, "Subsea Cementing Systems", p. 600.
B&W Incorporated Brochure, "B&W Rotating Surface Casing Cementing Method", p. 502.
B&W Incorporated Brochure, "Gravel Compaction", pp. 509–510.
TAM International Brochure, "TAM Casing Circulating Packer", 1991.
Frank's Casing Crew & Rental Tools, Inc., Brochure, "HiTop Model FC–1 Fill–Up/Circulation Tool".
Frank's Casing Crew & Rental Tools, Inc., Technical Manual, "HiTop Oil Tools", Rev. A, Mar. 2, 1995.
Frank's Casing Crew & Rental Tools, Inc., Technical Manual, "HiTop Oil Tools", Rev. A, Feb. 2, 1995.
TAM International Article, Running Procedure for 11" & 7" O.D. Casing Circulating Packer Fill–Up, 13 3/8" & 9 5/8" Casing, Mar. 9, 1993, pp. 1–2.

(List continued on next page.)

*Primary Examiner*—Hoang Dang
(74) *Attorney, Agent, or Firm*—Steve Rosenblatt

(57) ABSTRACT

Multiple embodiments of a system for capturing displaced fluid or adding fluid to tubulars being run into or out of the wellbore are described. Several embodiments are supported by a top drive with telescoping features to rapidly seal over a tubular to connect the tubular to a mudline. A flapper valve in one embodiment is described to keep fluid from spilling when the apparatus is removed from the tubular. In the event of a well kick, the valve can be shattered with pressure from the mudline. In another embodiment, the apparatus can be placed in sealing contact with the tubular and can incorporate a valve which can be manually closed in the event of a well kick. In yet another alternative, the incorporated valve can be automatically actuated to open as the apparatus sits on the tubular and closed as the apparatus lifts from the tubular. In yet another embodiment, sealing contact with the tubular can be obtained by simply advancing the apparatus into the tubular.

19 Claims, 40 Drawing Sheets

U.S. PATENT DOCUMENTS

| | | | | | |
|---|---|---|---|---|---|
| 2,223,388 | A | | 1/1940 | Scaramucci | |
| 2,263,758 | A | * | 11/1941 | Brown | 294/86.17 |
| 2,536,431 | A | * | 1/1951 | Endsley | 138/89 |
| 2,620,037 | A | | 12/1952 | McClendon | |
| 3,278,220 | A | * | 10/1966 | Wilson | 294/86.25 |
| 3,361,453 | A | | 1/1968 | Brown et al. | |
| 3,863,716 | A | | 2/1975 | Streich | |
| 3,915,226 | A | | 10/1975 | Savage | |
| 4,076,083 | A | | 2/1978 | Sizer | |
| 4,100,968 | A | | 7/1978 | Delano | |
| 4,111,261 | A | | 9/1978 | Oliver | |
| 4,188,050 | A | | 2/1980 | Lochte | |
| 4,246,967 | A | | 1/1981 | Harris | |
| 4,290,482 | A | | 9/1981 | Brisco | |
| 4,433,725 | A | | 2/1984 | Bowyer | |
| 4,522,430 | A | | 6/1985 | Stromberg | |
| 4,524,998 | A | | 6/1985 | Brisco | |
| 4,566,168 | A | | 1/1986 | Stromberg | |
| 4,613,161 | A | | 9/1986 | Brisco | |
| 4,624,483 | A | | 11/1986 | Stromberg | |
| 4,655,286 | A | | 4/1987 | Wood | |
| 4,655,302 | A | | 4/1987 | McCreadie et al. | |
| 4,718,495 | A | | 1/1988 | Lubitz et al. | |
| 4,817,724 | A | | 4/1989 | Funderburg, Jr. et al. | |
| 4,913,231 | A | | 4/1990 | Muller et al. | |
| 4,993,488 | A | * | 2/1991 | McLeod | 166/72 |
| 4,997,042 | A | | 3/1991 | Jordan et al. | |
| 5,012,865 | A | | 5/1991 | McLeod | 166/90.1 |
| 5,152,554 | A | | 10/1992 | LaFleur et al. | |
| 5,191,939 | A | | 3/1993 | Stokley | |
| 5,197,773 | A | * | 3/1993 | Vick, Jr. | 294/86.18 |
| 5,236,035 | A | | 8/1993 | Brisco et al. | |
| 5,249,629 | A | | 10/1993 | Jennings | |
| 5,282,653 | A | | 2/1994 | LaFleur et al. | |
| 5,348,351 | A | | 9/1994 | LaFleur et al. | |
| 5,411,095 | A | | 5/1995 | Ehlinger et al. | |
| 5,413,171 | A | | 5/1995 | Womack | |
| 5,435,390 | A | | 7/1995 | Baugh et al. | |
| 5,441,310 | A | | 8/1995 | Barrett et al. | |
| 5,443,122 | A | | 8/1995 | Brisco | |
| 5,499,687 | A | | 3/1996 | Lee | |
| 5,501,280 | A | | 3/1996 | Brisco | |
| 5,553,667 | A | | 9/1996 | Budde et al. | |
| 5,577,566 | A | | 11/1996 | Albright et al. | 175/321 |
| 5,584,343 | A | | 12/1996 | Coone | |
| 5,641,021 | A | | 6/1997 | Murray et al. | |
| 5,645,131 | A | | 7/1997 | Trevisani | |
| 5,660,234 | A | | 8/1997 | Hebert et al. | |
| 5,682,952 | A | | 11/1997 | Stokley | |
| 5,735,348 | A | | 4/1998 | Hawkins, III | |
| 5,813,483 | A | | 9/1998 | Latham et al. | |
| 5,918,673 | A | | 7/1999 | Hawkins et al. | |
| 5,971,079 | A | | 10/1999 | Mullins | |
| 5,992,520 | A | | 11/1999 | Schultz et al. | |
| 2001/0042625 | A1 | | 11/2001 | Appleton | 166/379 |

OTHER PUBLICATIONS

LaFleur Petroleum Services, Inc., Procedural Brochure, "Autoseal Circulating Head", Apr. 25, 1995, pp. 1–10.

Wassenborg, M., "Franks FC–1 Circulation Packer Washes 13 5/8" Casing to Bottom", The Brief,6/95.

Halliburton Services, Technical Drawing #3841.

Davis–Lynch, Equipment Catalog No. 11, 1993, 866–895.

Halliburton Information, Oil & Gas Journal, p. 12.

Composite Catalog, 1965, "Brown Hyflo Liner Packers", p 944.

PBL Drilling Tools, Ltd., Brochure, Hydro Mechanical Casing Circulator.

Composite Catalog, "Brown Duo–Packer", p. 919.

Composite Catalog, Baker Packers, "Waterflood Systems", p. 701.

Composite Catalog, Arrow Oil Tools, Inc., Retrievable Bridge Plug, p. 296.

Composite Catalog, Bowen Power Equipment, Bowen Power Swivels, pp. 565, 567.

Wepco Brochure, "Hydraulically Operated Circulation Head".

Miscellaneous information on Davis–Lynch, Inc., Fill and Circulate (FAC) Tool for Top Drive Drilling Systems, 2 pages, date unknown.

Halliburton Services, information on Quick–Latch Coupler Head, Oil & Gas Journal, 1 p., 10/88.

Misc. information on Halliburton Services Plug Containers, Selective Release Plug System and SSR (Sub–Surface Release) Cementing Plug Method, 4 pages, date unknown.

Frank's International, Brochure on Fill–Up & Cementing Tool System and FC–1 Fill–Up & Circulating Tool With Sliding Sleeve, 2 pages, date unknown.

Frank's Hilltop, drawings, 5 pages, date unknown.

HiTop Oil Tools, Misc. information on Model FC–1 Fill–Up Circulation Tool, 2 pages, date unknown.

Drawing of Lafleur Petroleum Services AutoSeal Circulating Head, 1 page, date unknown.

Misc. information on Tam International Casing Circulating Packers, 8 pages, date unknown.

Guiberson Type GW Packer Cup; p. 1964 (1950 Composite).

Page Oil Tools, Inc. Bottom Hole Oil and Gas Separator ; p. 3965 (1950 Composite).

McGaffey–Taylor Corp., Oil Well Service; M& T Show Squeeze Tool; pp. 3634–3635; (1960 Composite).

Guiberson, GW Cup Type Packers; p. 2176; (1966/67).

Guiberson, Typical GW Packer Applications; p. 2177; (1966/67).

Guiberson, Type SJ Circulating Slide Valve; p. 2183; (1966/67).

Page Oil Tools, Page Forced Flow Downhole Separator, p. 3959; (1966/67).

PBL Drilling Tools, Ltd. Brochure, Hydro mechanical Casing Circulator, 2 pages, date unknown.

CFT Drill Pipe Circulating & Flow–Back Tool Brochure, Gus Mullins & Associates, 1999, 2 pages.

Wepco information on Wepco Hydraulicall Operated Circulation Head for Casing Running in Highly Deviated–/tight wells, date unknown, 5 pages.

* cited by examiner (VALVE OPEN)

(VALVE CLOSED)

TUBULAR FILLING SYSTEM

This application is a divisional application claiming priority from U.S. patent application Ser. No. 10/052,301, filed on Jan. 18, 2002, now U.S. Pat. No. 6,604,578, which is a divisional application claiming priority from U.S. patent application Ser. No. 09/638,809, filed on Aug. 14, 2000, now U.S. Pat. No. 6,415,862, which is a divisional application claiming priority from U.S. patent application Ser. No. 09/161,051, filed on Sep. 25, 1998, now U.S. Pat. No. 6,390,190, which claims the benefit of U.S. provisional application No. 60/084,964, filed on May 11, 1998.

FIELD OF THE INVENTION

The field of this invention relates to an apparatus for filling or circulating fluids in tubulars for running in or coming out of the wellbore, and for recovery of fluids displaced when running in tubulars in the wellbore.

BACKGROUND OF THE INVENTION

When tubulars are being run or pulled from a wellbore, it is often necessary to fill the tubular, take returns from the tubular, or circulate fluid through the tubular to the lowest point in the wellbore to condition the fluid system or the wellbore or to control a "kick" or high pressure surge from the well. Previous devices for filling and circulating the wellbore are firmly attached to the traveling block, in the case of a conventional rig, or to the top drive, in the case of a top drive-equipped rig. In either case a very precise spacing is required of the seal assembly relative to the tubular and elevators. In the case where slip-type elevators are used, the spacing of the seal could be such that when the elevators were near the upset of the tubular, the seal could be out of the tubular. When required, the slips at the rig floor must be set on the tubular and the traveling block or top drive lowered in order to move the seal into sealing engagement with the tubular. This required that the running or pulling of the tubular stop until the slips were set at the rig floor and the seal engagement was made. This is not desirable when a well kick occurs or fluid is overflowing from the tubular. It must be noted that slip-type elevators are used infrequently due to their size, weight, and the time required to latch and unlatch them since they must be placed over the top of the tubular and lowered to the desired location in order to latch and grip the tubular, a process that is almost impossible when tubulars are racked back in the derrick and the top of the tubular is far above the derrick man's head.

In the case where "side door" or latching elevators are used, the spacing of the seal system is even more critical and the seal must be engaged in the tubular prior to latching the elevators below the upset portion of the tubular. This requires that the seal be engaged in the tubular at all times that the elevators are latched on the tubular. When tubulars are racked back in the derrick such as drill pipe or a work string, it would be very time-consuming if not impossible to insert the seal into the tubular prior to latching the elevators with the top of the tubular far above the derrick man. Also, with the seal engaged in the tubular at all times, this is a disadvantage when there is a need to access the top of the tubular while the tubulars are in the elevators or when the tubular is being filled with fluid and the air in the tubular begins to be entrained in the fluid column rather than escaping the tubular. For example, if a high-pressure line was to be attached to the tubular and the tubular moved at the same time, all previous devices had to be "laid down" to allow a hard connection to be made to the tubular since they are in the way of the tubular connection.

It will be seen that the invention described in this application, with its extending and retracting features and the ability to easily connect to or disconnect seal or unseal from the tubular, is very advantageous during any of the operations involved in well control, drilling, completion, workover, fishing or running and pulling the tubular, and eliminates all of the disadvantages of the prior art.

When tubular such as casing is run into a wellbore, each successive stand is attached and filled with mud as it is run into the wellbore. As the casing or tubing advances into the wellbore, a certain amount of mud is displaced. If the casing is open-ended on bottom or has a check valve, advancement of the casing or tubular into the wellbore will force mud from the wellbore uphole. If the tubular or casing is installed in a situation of fairly tight clearances, rapid advancement of the tubular into the wellbore will result in significant flow of mud through the tubular onto the rig floor area. Conversely, when attempting to pull the tubular out of the wellbore, resistance to extraction can be experienced and consequently "swabbed in" unless compensating fluid can be added into the wellbore to maintain sufficient hydrostatic pressure created by extraction of the tubular. Thus, there arises a need for a device which will simply allow capturing of any displaced returns during advancement of the tubular or, alternatively, allow rapid filling of the tubular for insertion into or extraction out of the wellbore.

Another situation that needs to be dealt with during these procedures is the ability to handle sudden surges of pressure from the formation to the surface. In these situations, it is desirable to be able to secure a valve in the string connected to the mud supply so that the pressure surge from the wellbore can be contained. Thus, an objective of the present invention is to allow rapid connection and disconnection to a tubular being added or removed from a string during insertion or removal operations, while at the same time allowing rapid threaded connection to the string with an integral valve which can be manually or automatically operated so as to shut-in the well and thereafter control the well by applying fluid behind the valve which has been used to control the pressure surge from the formation.

It is yet another object of the present invention to allow a system of rapid connection and disconnection to the tubular for filling or capturing of returns with minimal or no spillage in the rig floor area.

It is another object of the present invention to allow circulation of fluid at any time during rig operations for conditioning the wellbore, fluid system, or controlling a kick.

Prior systems relating to techniques for filling casing are disclosed in U.S. Pat. Nos. 5,152,554; 5,191,939; 5,249,629; 5,282,653; 5,413,171; 5,441,310; and 5,501,280, as well as U.S. Pat. No. 5,735,348.

The objectives of the present invention are accomplished through the designs illustrated and described below where the preferred embodiment and alternative embodiments are specified in greater detail.

SUMMARY OF THE INVENTION

Multiple embodiments of a system for capturing displaced fluid or adding fluid to tubulars being run into or out of the wellbore are described. Several embodiments are supported by a top drive with telescoping features to rapidly seal over a tubular to connect the tubular to a mudline. A flapper valve in one embodiment is described to keep fluid from spilling when the apparatus is removed from the tubular. In the event of a well kick, the valve can be shattered with pressure from the mudline. In another embodiment, the apparatus can be placed in sealing contact with the tubular and can incorporate a valve which can be manually closed in the event of a well kick. In yet another alternative, the incorporated valve can be automatically actuated to open as the apparatus sits on the tubular and closed as the apparatus lifts from the tubular. In yet another embodiment, sealing contact with the tubular can be obtained by simply advancing the apparatus into the tubular.

DETAILED DESCRIPTION OF THE PREFERRED EMBODIMENT

Referring now to FIGS. 1–10, the first embodiment, originally disclosed in provisional application serial No.

Figure 1:
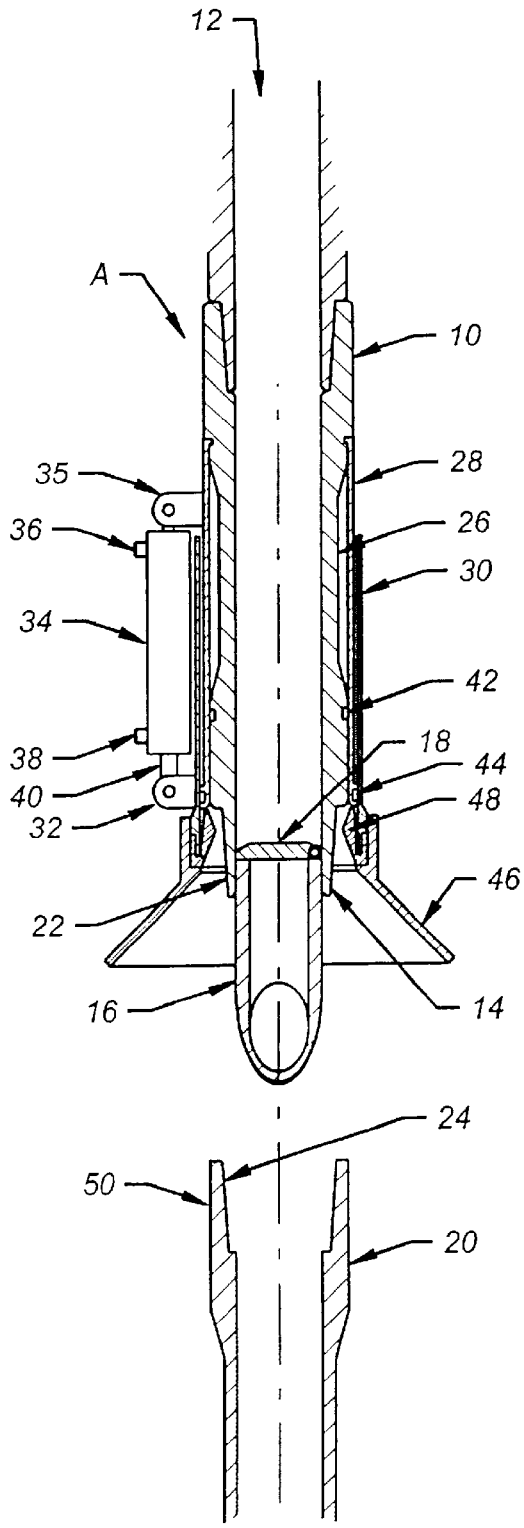
FIG. 1 is a sectional elevational view of one embodiment employing a telescoping feature and a built-in flapper valve for mud spill control, showing the apparatus approaching a tubular to be run into the wellbore.
Figure 4:
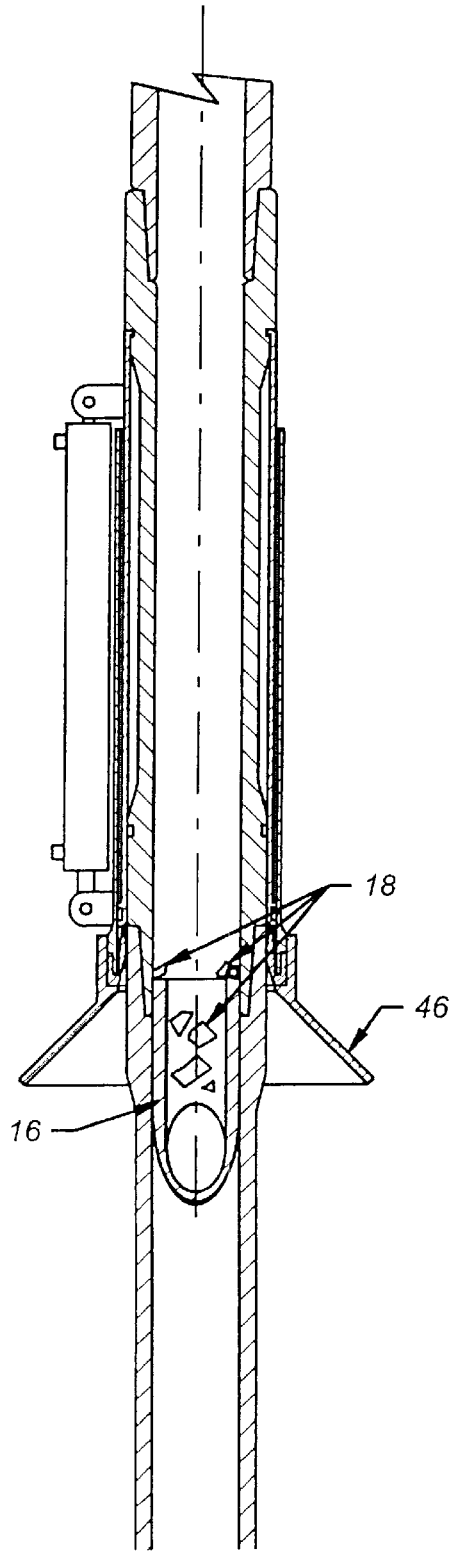
FIG. 4 shows the apparatus of FIG. 3, with pressure applied from above shattering the flapper valve which normally retains fluid when the apparatus is disconnected from a tubular.

60/084,964 filed May 11, 1998, will be described. Referring to FIG. 1, the apparatus A has a tubular body 10, with a bore 12. Located at the lower end 14 of body 10 is a valve assembly 16 which includes a flapper 18, shown in the closed position in FIG. 1. The purpose of the flapper 18 is to close when the assembly is lifted away from the tubular 20 so that the mud in bore 12 does not spill out on the rig floor. However, the material construction of the flapper 18 is preferably easily breakable under pressure applied from the rig pumps as shown in FIG. 4 where the flapper has broken into little pieces so that pressure can be applied to the wellbore for well control in the event of an unexpected surge in pressure from downhole. The valve body 16 is secured to the tubular body 10. Thread 22 is on the lower end of the body 10 and is selectively securable to thread 24 in the tubular 20, as will be explained below.

Body 10 has a recess 26 with sleeve 28 mounted over recess 26. Sleeve 30 is mounted over sleeve 28 and has lug 32 extending therefrom. A cylinder 34 receives hydraulic or other fluid or gas through connections 36 and 38 for respective downward and upward movements of shaft 40, which is in turn connected to lug 32. Lug 32 can be actuated mechanically or electrically where cylinder 34 is an electric motor/lead screw device as alternatives. Cylinder 34 is supported from lug 35 which is secured from the top drive (shown in FIG. 5) so that body 10 can be rotated with respect to sleeves 28 and 30 to secure thread 22 to thread 24. Extension of shaft 40 moves lug 32 downwardly and extends sleeve 30 downwardly with respect to stationary and rotatable sleeve 28. Located on body 10 is seal 42 to seal between sleeve 28 and body 10. Another seal 44 seals between sleeves 28 and 30.

Figure 2:
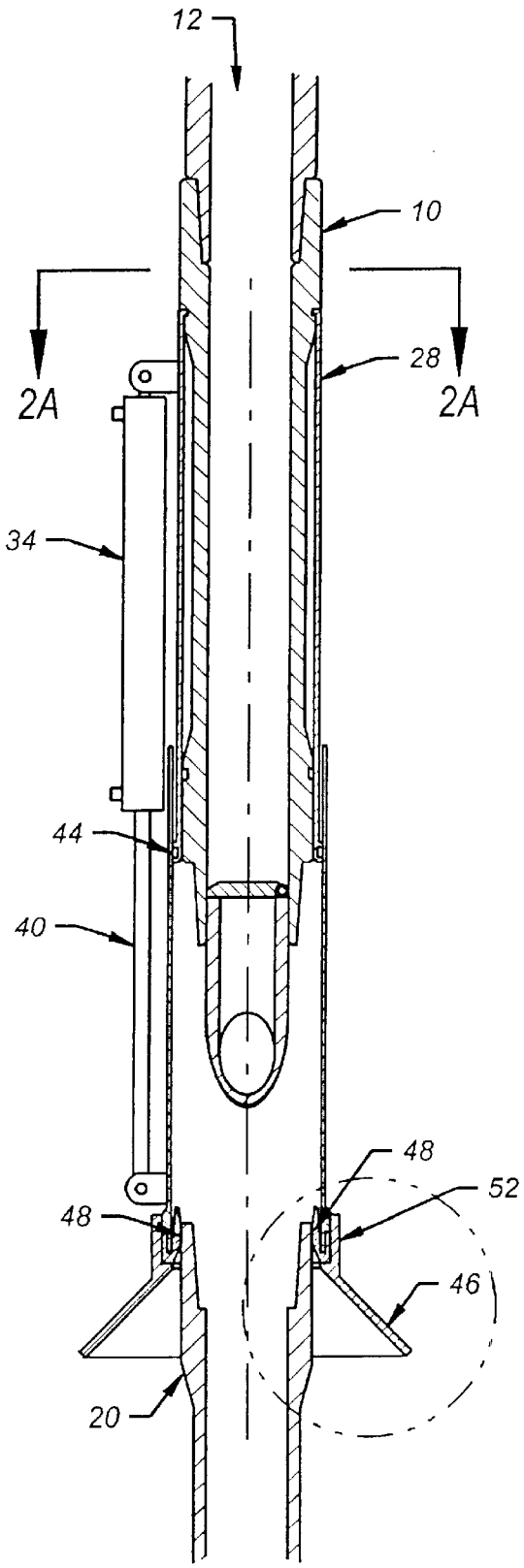
FIG. 2 is the view of FIG. 1, showing the apparatus extended into contact with the tubular.
Figure 2A:
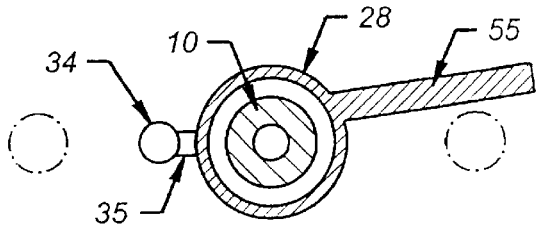
FIG. 2A is a section view of FIG. 2, showing the rotational restraining tab.
Figure 2B:
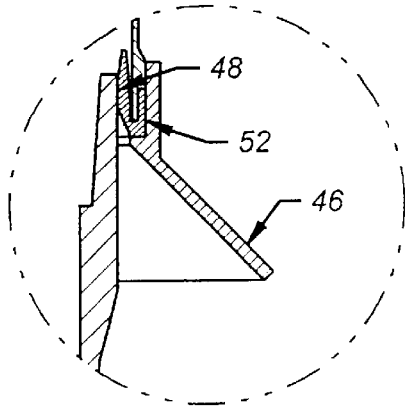
FIG. 2B is a detail view of the tubular seal in FIG. 2.

At the lower end of sleeve 30 is skirt 46 which serves as a guide for sleeve 30 over the tubular 20. Located at the bottom of sleeve 30 is an internal seal 48 which is a ring-shaped seal having a chevron configuration in cross-section in the preferred embodiment, which is designed to land near the top end 50 of the tubular 20 for sealing engagement to the outer surface of the tubular 20. FIG. 2B shows the working of seal 48 in cross-section, illustrating its chevron design with opposed wings, one of which rests on the tubular 20 and the other 52 sealing against the lower portion of the sleeve 30.

Figure 3:
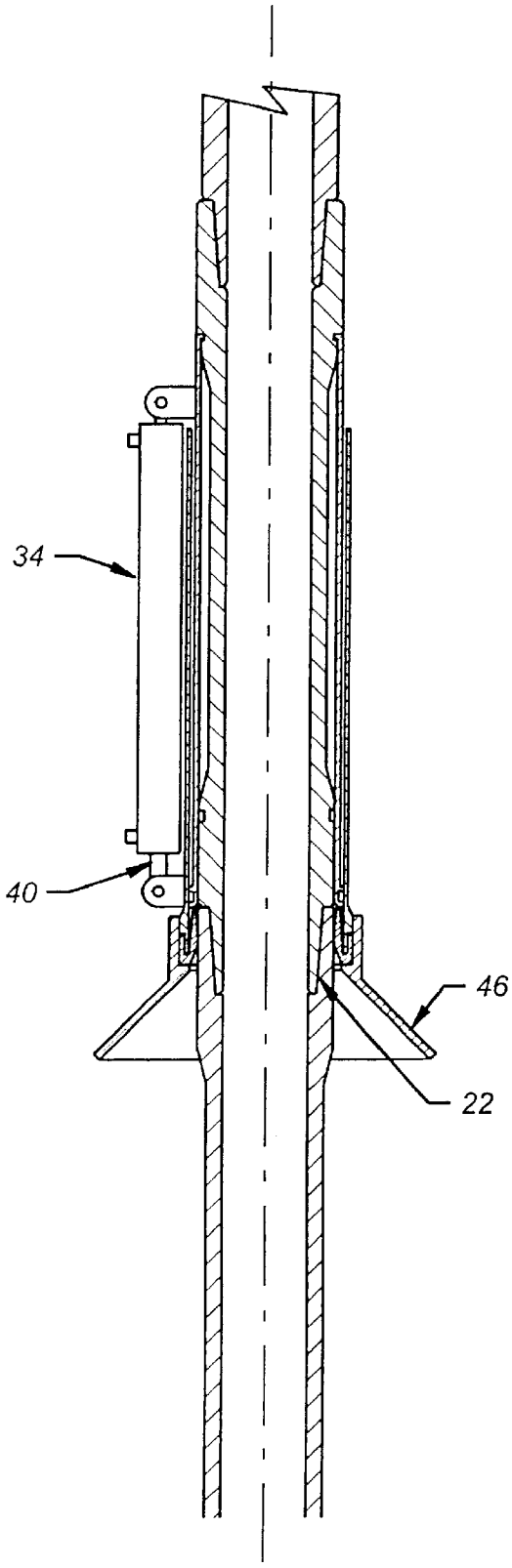
FIG. 3 shows the apparatus threaded into the tubular in the event of a pressure surge from the well.

The valve assembly 16 is an optional feature which can be attached at the lower end 14 of the tubular body 10 or it can be omitted completely. When the sleeve 30 is telescoped downwardly, as shown in FIG. 2, and the seal is established against the tubular 20, the tubular can be run into the well and any displaced mud will come up past the flapper 17 and flow upwardly through the bore 12 back to the mud pit. Should it become necessary, the thread 22 can be secured to the thread 24 through the use of the top drive 54, as shown in FIGS. 3, 4, 7 and 8. A tab 55 shown in FIG. 2A (Section B—B) extends from the sleeve 28, or from any other location, connected to sleeve 30 to hold it against rotation. Those skilled in the art will appreciate that the tubular body 10 can be rotated with respect to sleeves 28 and 30 to secure thread 22 to thread 24. This situation could become necessary if a sudden rise in pressure from the well below occurs and pressure is needed from the mud pumps to control the well. At that point, it is not desirable to rely on the sealing capability of seal 48 and it is preferable to have a hard pipe connection between threads 22 and 24. Such a connected position is shown in FIG. 3. It should be noted that in FIG. 3, the mud saver valve assembly 16 has been removed. The connection between threads 22 and 24 can be made-up, regardless of whether the valve assembly 16 is employed. If the valve assembly 16 is still in position, as shown in FIG. 4, pressure from the mud pumps simply breaks the flapper 18 to allow well pressurization with heavy fluids so as to bring the well under control in an emergency situation.

Another feature of this embodiment of the present invention is that pressure in bore 12, as extended when sleeve 30 is brought down toward tubular 20, acts to put a net force on sleeve 30 to hold it down on the tubular 20. This occurs because there is a bearing area for the pressure within sleeve 30 adjacent seal 48 which is far larger than any available bearing area from the presence of seal 44 near the top of sleeve 30, as shown in FIG. 2. Thus, the presence of internal pressure in bore 12 gives a supplemental force to the sleeve 30 to hold the seal 48 against the tubular 20.

Figure 5:
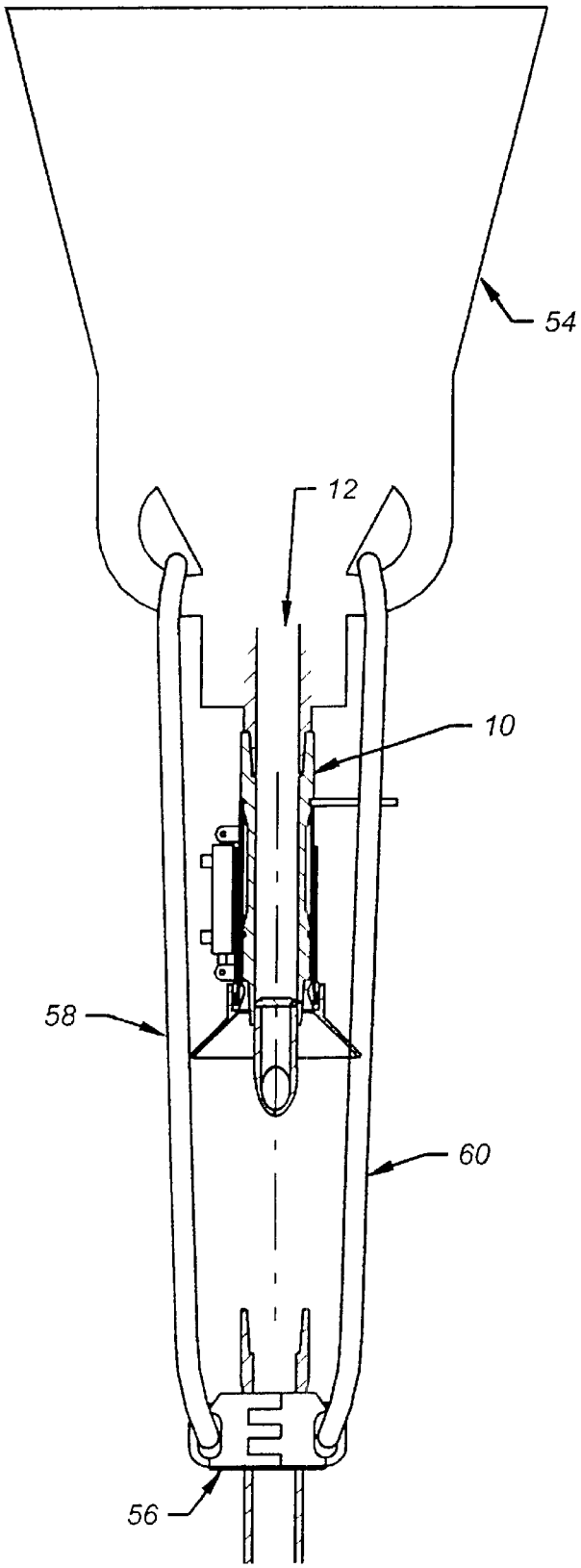
FIG. 5 shows the apparatus of FIG. 1 in the position of FIG. 1, while further illustrating the positioning of the top drive supporting the apparatus.
Figure 6:
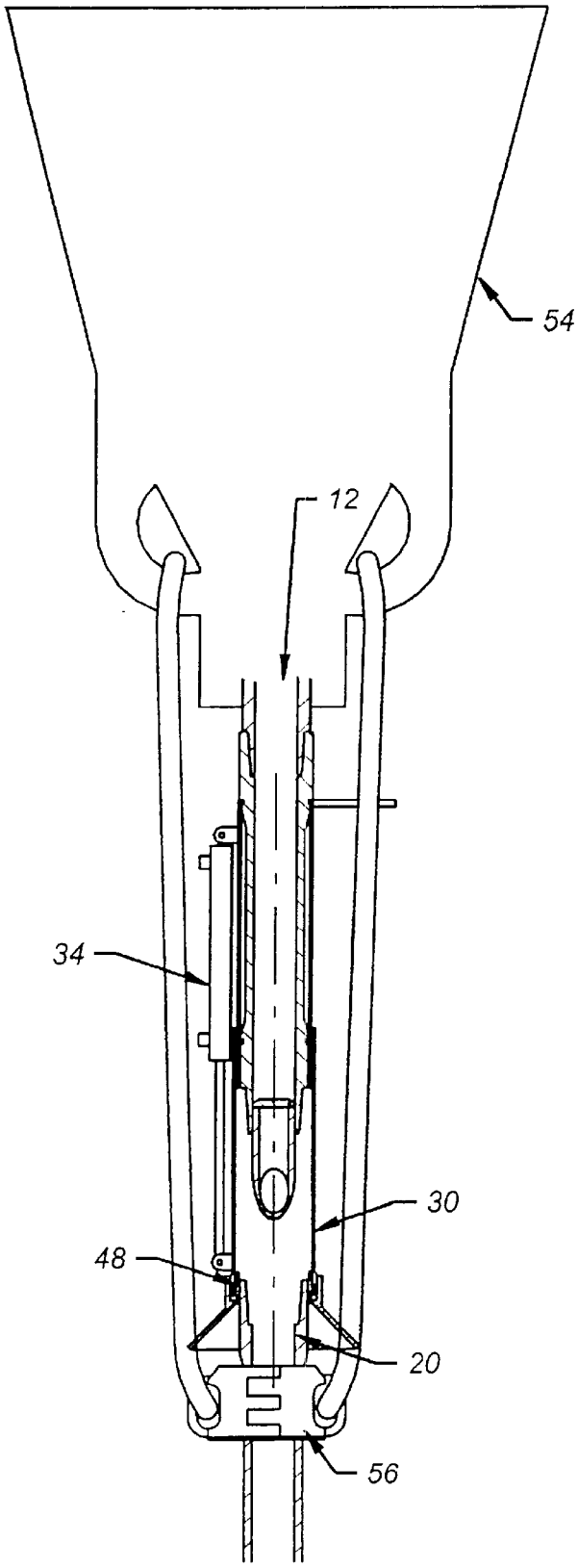
FIG. 6 is the view of FIG. 5 where the apparatus has been telescoped onto the tubular.

Referring now to FIGS. 5–8, the various steps shown in FIGS. 1–4 are illustrated again, with the further addition of the top drive 54. In FIG. 5, the top drive 54 is connected to the body 10 so that mud can be pumped through the top drive 54 down the bore 12 should that become necessary to control the well. Conversely, advancing the tubular 20 into the wellbore displaces fluid through the bore 12 into the top drive 54 and back to the mud pit through a mud hose. Shown in FIG. 5 is an elevator 56 which is supported by a pair of bails 58 and 60. The apparatus substantially as shown in FIG. 1 is also shown in FIG. 5 and its details will not be repeated. Referring to FIG. 6, the cylinder 34 has been actuated to extend sleeve 30 such that seal 48 is sealingly engaged to the tubular 20. The assembly including the top drive 54 can be let down with rig equipment, allowing the tubular 20 to be lowered using the elevators 56, with fluid displaced upwardly through bore 12 back to the mud pits.

Figure 7:
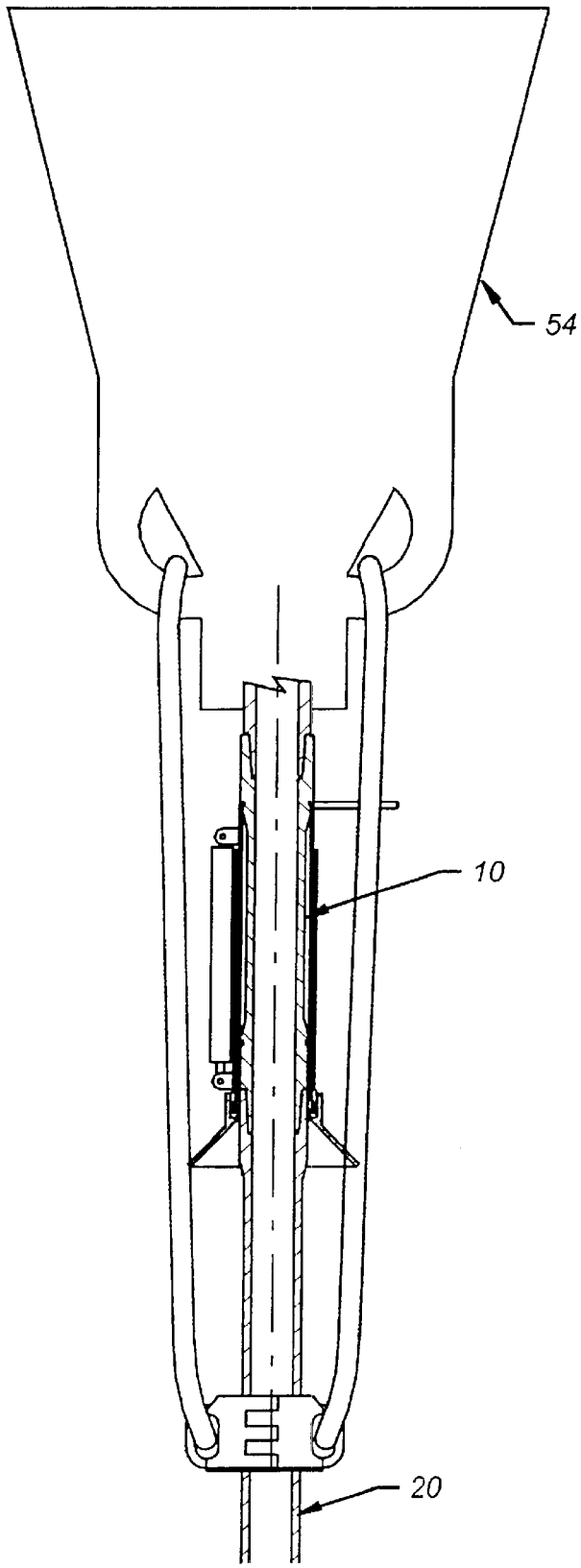
FIG. 7 is the apparatus shown in the position of FIG. 3, illustrating the top drive.

Referring to FIG. 7, the top drive 54 has been lowered so that the body 10 can have its thread 22 engage the thread 24 of the tubular 20 so that the top drive 54 can be operated to secure the body 10 to the tubular 20. The mud saver valve 16 is eliminated from the view of FIG. 7. It can be manually removed prior to connecting thread 22 to thread 24 or it can be eliminated altogether. Eliminating the valve assembly 16 altogether may cause some mud to dribble near the rig floor when the cylinder 34 is retracted since the height of bore 12 up to the mudline (not shown) would drain each time in the rig floor area without the use of the valve assembly 16.

Figure 8:
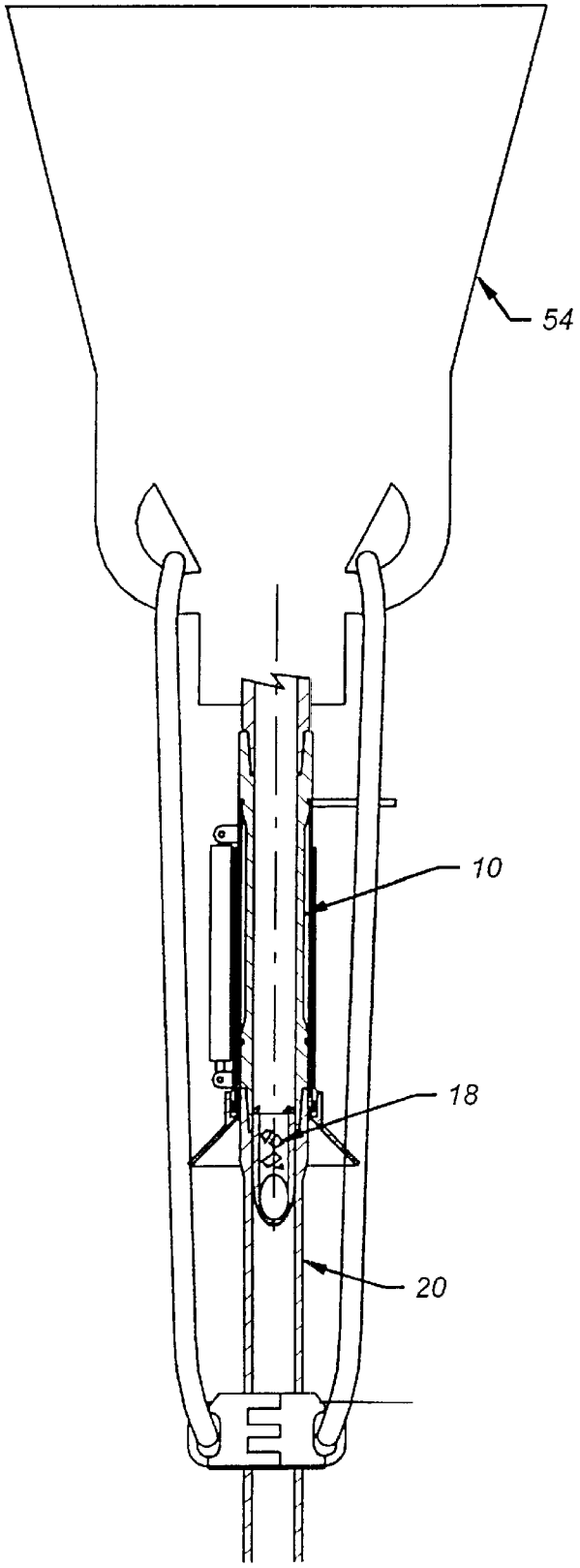
FIG. 8 is the apparatus shown in the position of FIG. 4, also illustrating the top drive.

FIG. 8 illustrates the threads 22 and 24 connected so that body 10 is threaded tightly to the tubular 20 with the mud pump turned on to break the flapper 18 into little pieces for control of the well below.

Figure 9A:
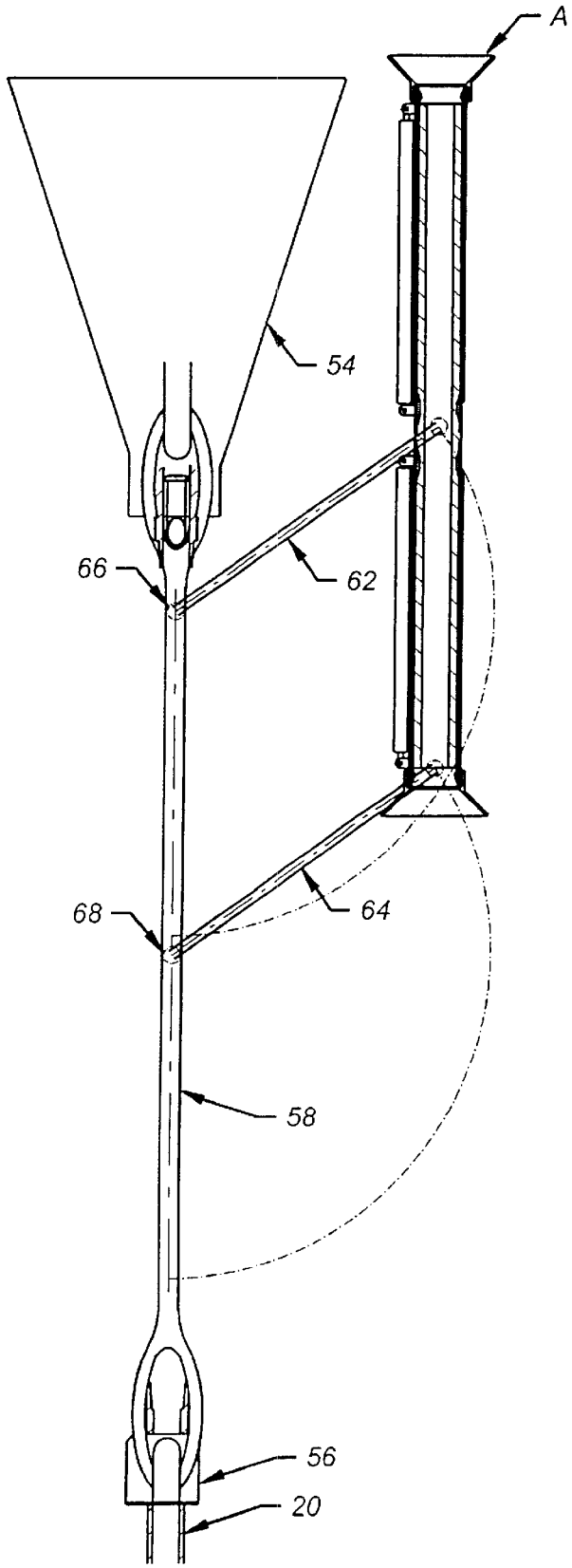
FIG. 9A shows a double-acting version of the apparatus mounted for swingaway action from the bails in a retracted position.
Figure 9B:
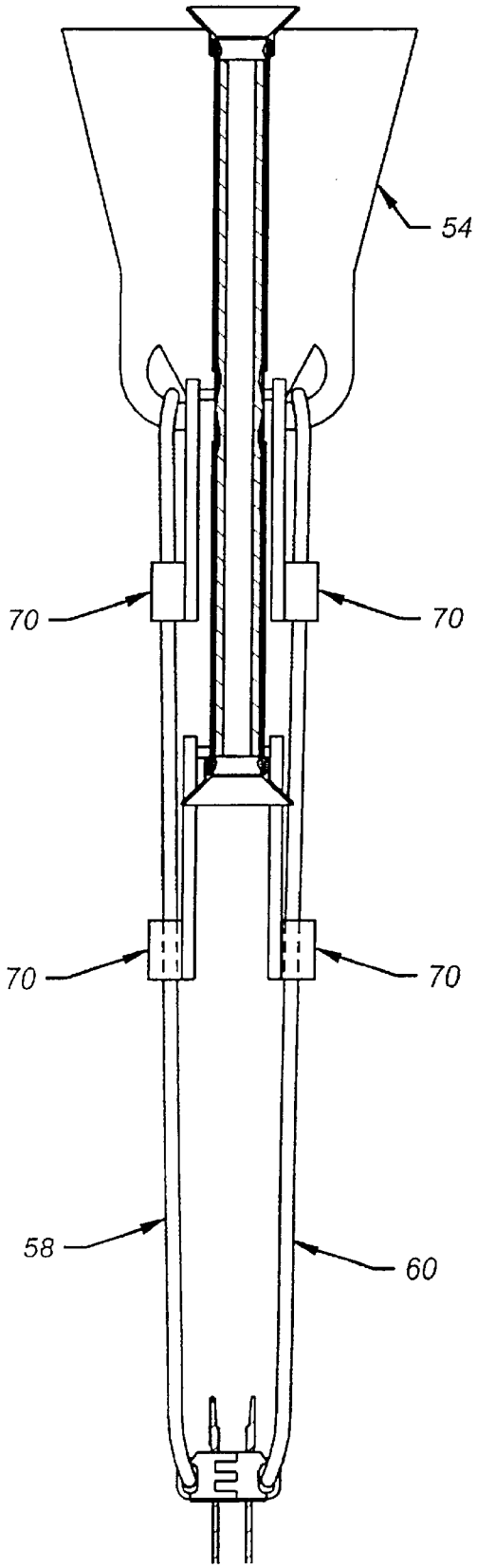
FIG. 9B is the view of FIG. 9A from a position rotated 90° around the vertical axis.
Figure 9C:
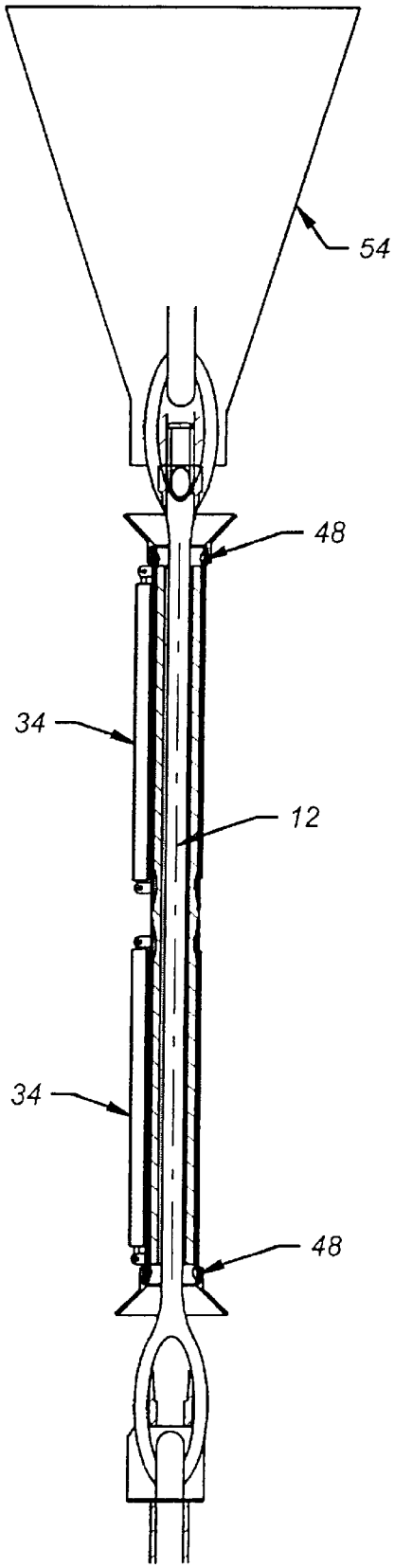
FIG. 9C is the view of FIG. 9A with the double-ended apparatus swung into position for contact with the tubular.

FIGS. 9*a*–*c* illustrate an alternative double-ended version which can telescope upwardly and downwardly. As shown in FIG. 9A, the apparatus A is merely two of the embodiments shown in FIG. 1 and is extendable in opposite directions. Swinging arms, such as 62 and 64, are each in pairs and pivoted from the bails, one of which 58 is shown in FIG. 9A. The pivot points on each bail are denoted as 66 and 68. Each of the arms 62 and 64 has a travel stop. All four travel stops are illustrated in FIG. 9B as 70. The travel stops 70 engage the bails 58 and 60 to place the apparatus A in the position shown in FIG. 9C. In the position shown in FIG. 9A, the apparatus A is out of the way so that a tubular 20 can be engaged in the elevator 56. Once the tubular 20 is secured in elevator 56, the apparatus A is allowed to swing in a clockwise direction until travel stops 70 come in contact with bails 58 and 60 and the position of FIG. 9C is assumed. Thereafter, the cylinders 34 and 34' can be actuated, whereupon a lower seal 48 will engage the top of the tubular 20 at its outer periphery, while an upper seal 48' will make contact with the top drive 54 for sealing engagement with the tubular 20 at the lower end and the top drive 54 at the upper end so that mud can flow therein without leakage. Again, a valve assembly, such as 16, can be incorporated into this design.

Figure 10:
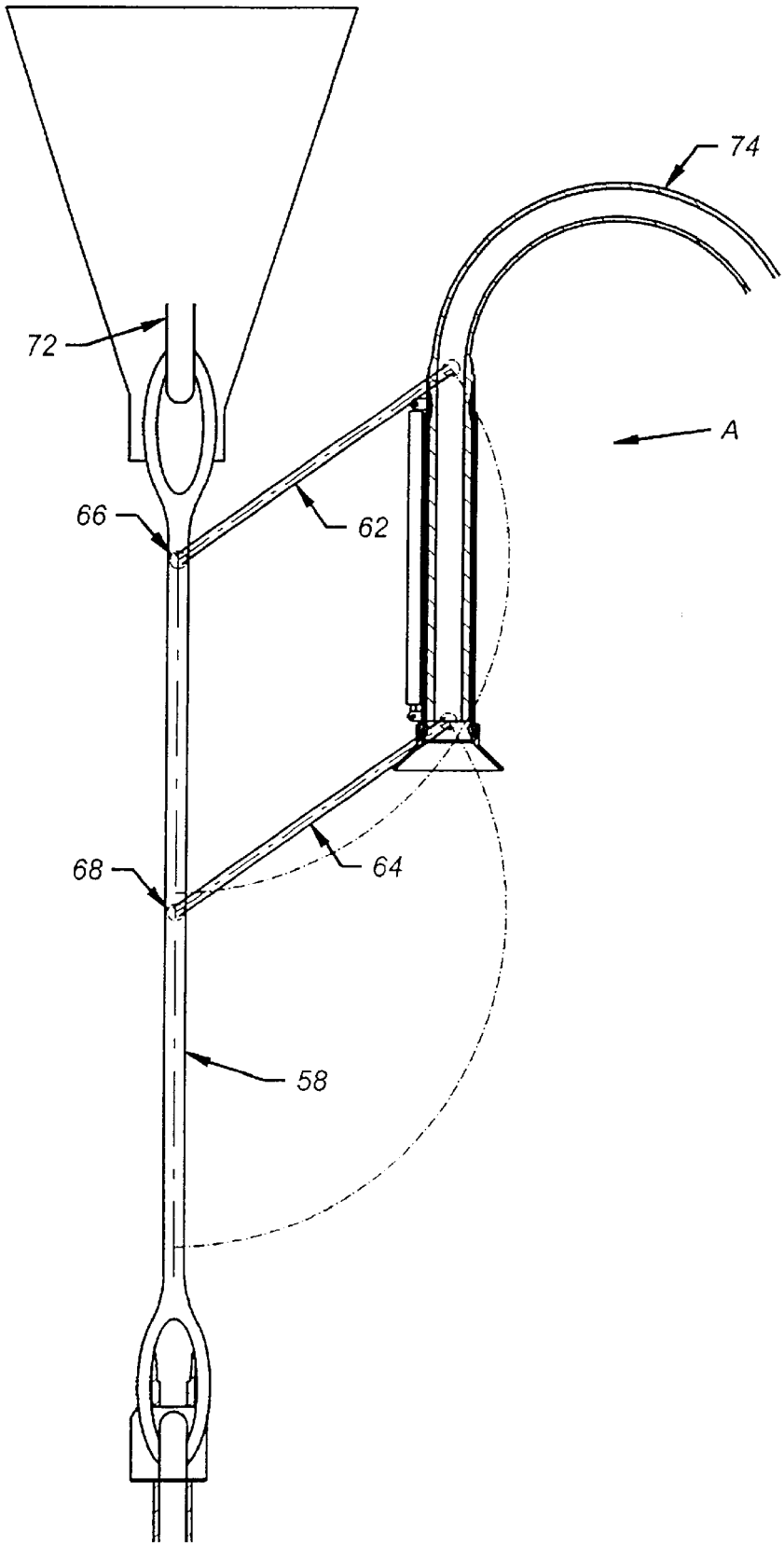
FIG. 10 is an alternative embodiment where there is no top drive and the mudline is hooked directly to a single-acting apparatus which can be swung out of the way when suspended from the bails.

An alternative design where no top drive is available is shown in FIG. 10. There, a hook 72 supports the bails 58 and 60, only one of which is shown in FIG. 10. The apparatus A swings out of the way by virtue of arms 62 and 64, as before. These arms pivot respectively from pivots 66 and 68, as before. The main difference is that the mud hose 74 is now connected directly to the apparatus A instead of through the top drive as it would in the installation of FIGS. 9*a–c*. In all other respects, the function of the apparatus A is as previously described.

Those skilled in the art will appreciate that this first-described embodiment has several advantages. Easy sealing contact can be made with a tubular 20 through the telescoping feature using the cylinder 34 in conjunction with the seal 48. A travel stop can also be incorporated with sleeve 30 to ensure the proper placement of seal 48 adjacent the outer periphery at the upper end of the tubular 20. The configuration of the area around seal 48 ensures that internal pressures in bore 12 produce a net force downwardly on sleeve 30 to hold seal 48 in position above and beyond the retention force applied to sleeve 30 through shaft 40 connected to the lug 32. The other advantage of the embodiment described in FIGS. 1–10 is that it has a body 10 with lower threads 22 which can be readily made-up to the tubular 20 by employing either the top drive 54 if available or through manual threading of thread 22 into thread 24. It can be appreciated that the system of "out of the way" when in the retracted position, allowing normal well operations such as pulling, running pipe, or drilling to occur without need to "lay the assembly down." It can also be appreciated that a "fill-up" valve can be incorporated in the body to prevent fluid from spilling on the rig floor while allowing fluid to return to the mud pit through the integral check valve.

Figure 11:
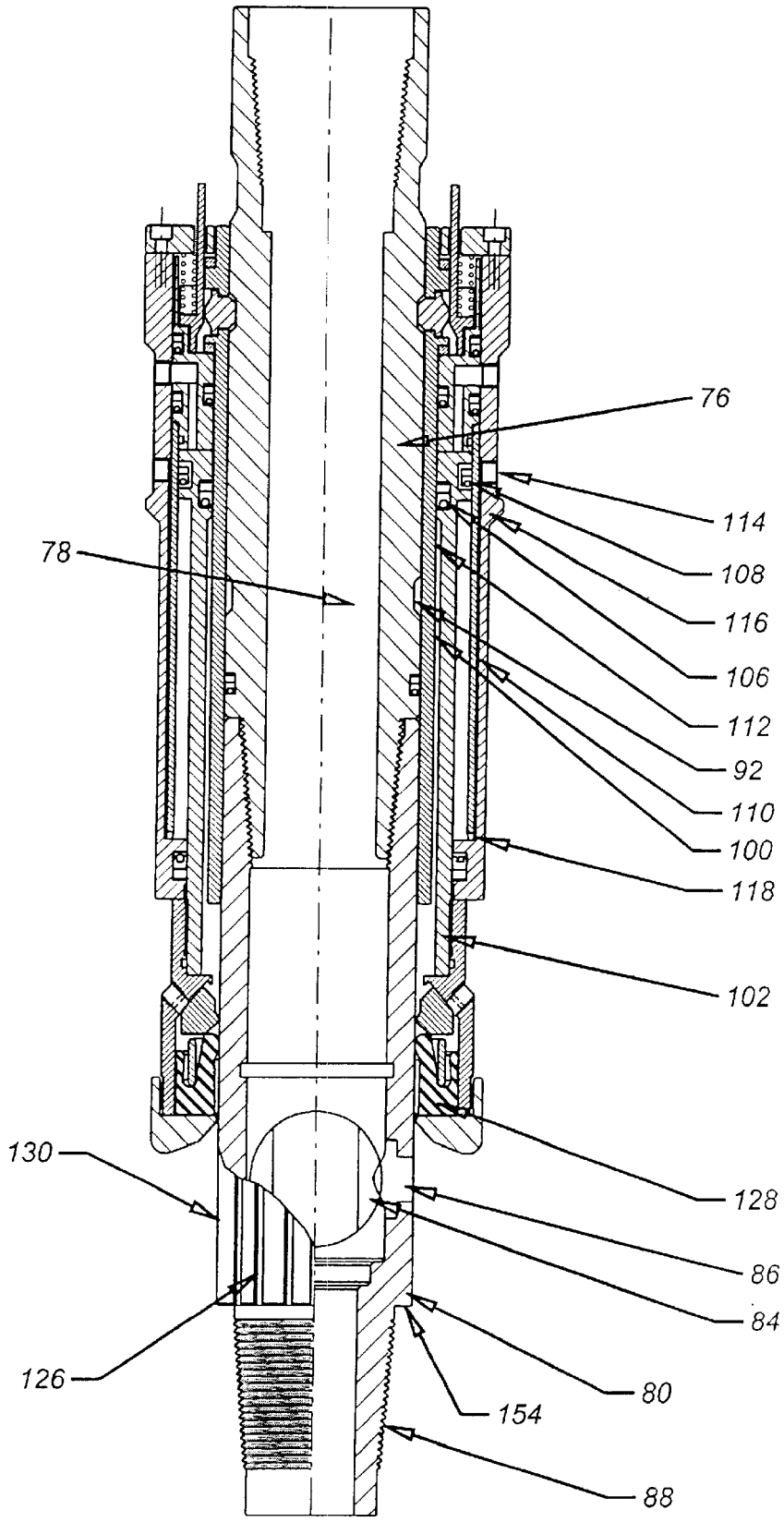
FIG. 11 is a sectional elevational view of an alternative embodiment in a retracted position.

Referring now to FIG. 11, the preferred embodiment of the present invention will be described.

Referring now to FIG. 11, the preferred embodiment of the apparatus A has a body 76 with a bore 78. Secured below body 76 is valve body 80, which is connected to body 76 at thread 82. Valve body 80 has a 90° ball 84, shown in FIG. 11 in the open position. Ball 84 can be manually operated through a hex connection 86 by sticking a wrench in it and rotating 90°. The valve body 80 has a thread 88 so that it can be secured to a tubular 90 (see FIG. 18) should the need arise for pressure control of the well. It will be recognized by those familiar with the art that the valve body can be at the upper end of the body assembly as well as the bottom, as illustrated with the hex connection 86 above the tab 94 shown in FIG. 12.

Figure 12:
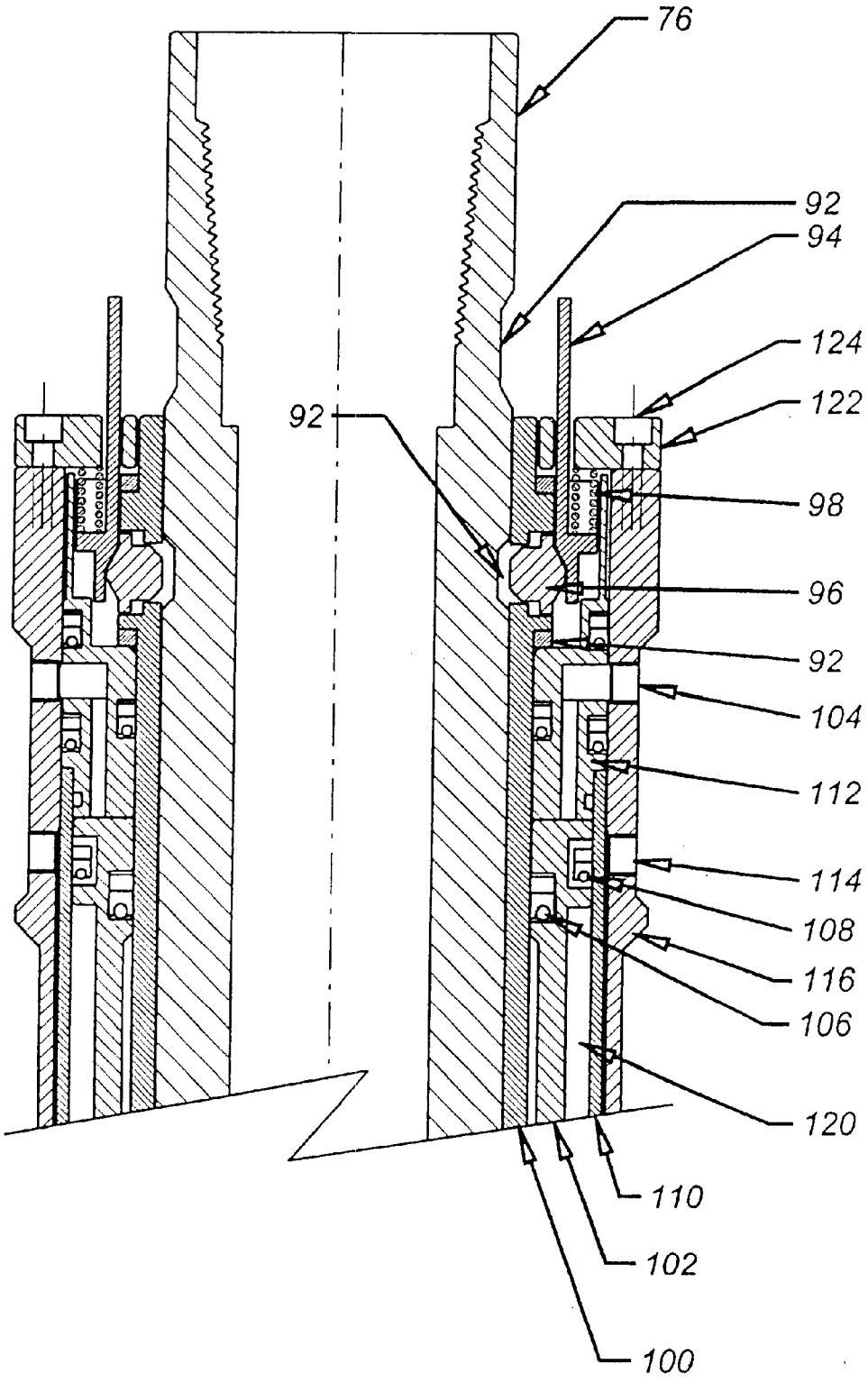
FIG. 12 is a detailed view of the top portion of FIG. 11.
Figure 13:
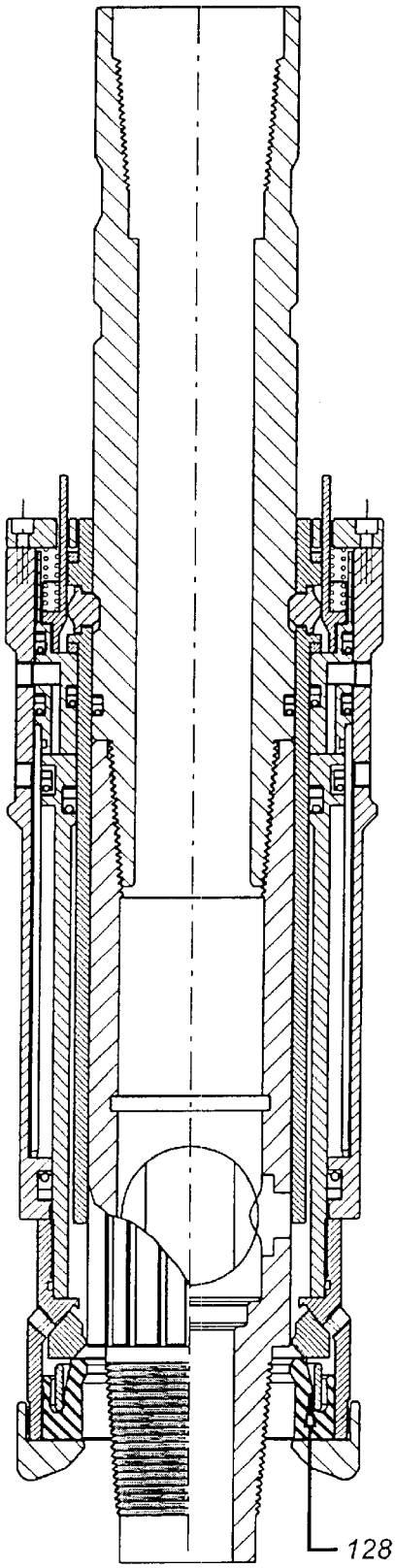
FIG. 13 is the view of FIG. 11 with the apparatus lowered into a position where it can contact a tubular below.

Referring to FIG. 12 for a closer look at the outer assembly on the body 76, it can be seen that body 76 has a series of external grooves 92 at different locations. In the position shown in FIG. 12, the apparatus A is in its initial position, but the outer assembly as will be described can be shifted with respect to the body 76. This occurs by lifting up tab 94 which allows dogs 96 out of groove 92. Tab 94 is biased downwardly by spring 98 so as to retain the locked position of dogs 96 through the window in inner sleeve 100. Thus, inner sleeve 100 has a multiplicity of positions relative to the body 76. Referring again to FIGS. 11 and 12, a piston 102 rides outside of the inner sleeve 100. Hydraulic fluid is connected to an inlet 104 and communicates with the top of the piston 102. Seal 106 is disposed between the inner sleeve 100 and the piston 102. Seal 108 is disposed between the piston 102 and intermediate sleeve 110. A seal 112 ensures that hydraulic fluid pumped into connection 114 travels downwardly between the intermediate sleeve 110 and an outer housing 116. Intermediate sleeve 110 has a series of slots or openings 118 (see FIG. 11) to allow fluid communication into cavity 120. Clearly, applying pressure through the connection 114 ultimately puts an upward force on piston 102, while applying pressure through the inlet 104 applies a downward pressure on piston 102. Those skilled in the art will appreciate that the outer housing 116 can be made in several components. A top plate 122 is secured by fasteners 124 and acts to ultimately support the outer housing 116 when the dog or dogs 96 are firmly engaged in a groove or grooves 92. The top plate 122 also holds in the spring 98.

Referring to FIG. 11, it will be noticed that there is a series of longitudinal flutes 126. The purpose of these is to prevent the seal 128 from sealingly engaging the outer surface 130 of the valve body 80 so as to prevent the piston 102 from being telescoped upwardly, as will be explained below.

Figure 14:
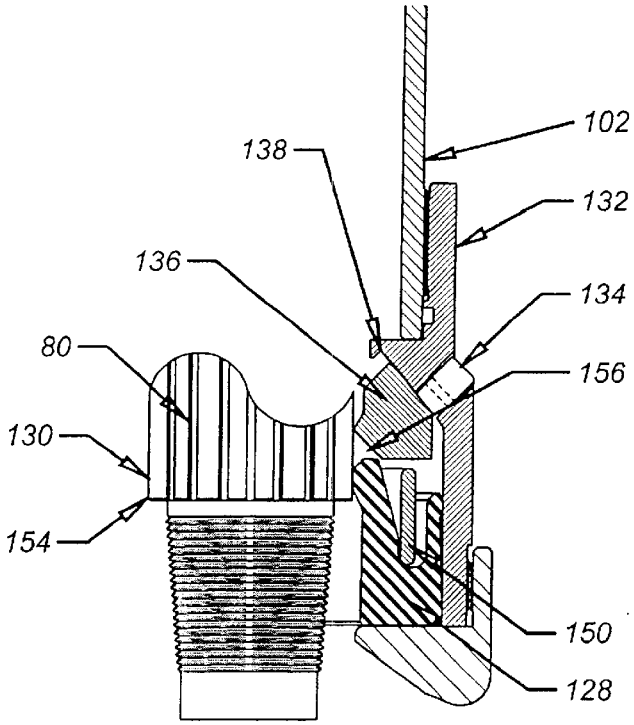
FIG. 14 is a detailed view of the bottom of a sliding assembly shown in FIG. 11.
Figure 15:
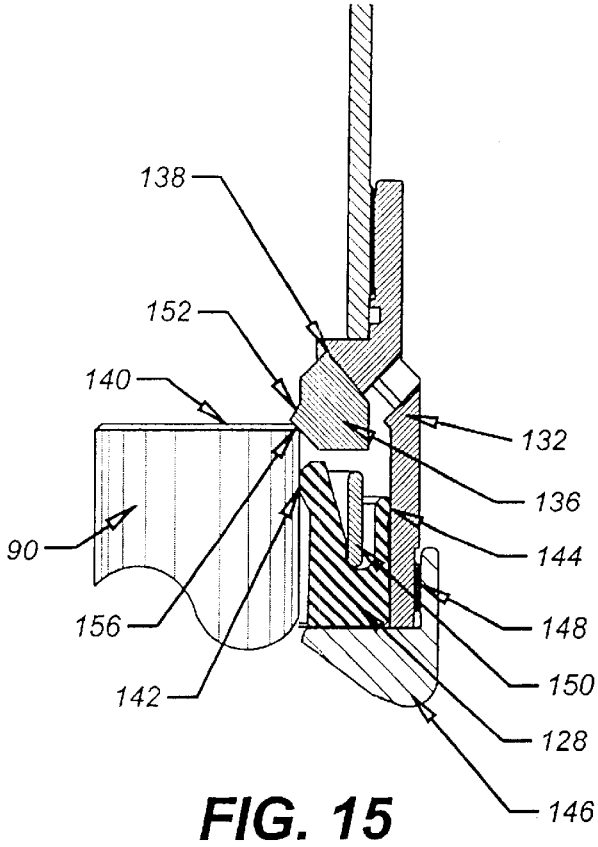
FIG. 15 is the view of FIG. 14 after the sliding assembly has come into contact with the tubular below.

The lower assembly adjacent the bottom of piston 102, while shown in FIG. 11, can be seen in greater detail in FIGS. 14 and 15. FIG. 14 represents the position of the components when the lower end of piston 102 is in the position shown in FIG. 11. FIG. 15 illustrates the position of the components when set against the tubular 90. Lower sub 132 is connected to the lower end of piston 102. It has a port 134 to which a pressure gauge can be connected or a vent valve to be sure that there is no internal pressure in the sub 132 before the seal 128 is lifted clear of the tubular. Located within the sub 132 is an expandable stop ring 136. A travel stop 138 limits the minimum diameter of stop ring 136. In the position in FIG. 11, the outer surface 130 of the valve body 80 pushes the stop ring 136 radially outwardly away from stop 138, as shown in FIG. 14. Stop ring 136 is an annularly shaped ring with selected cutouts to allow it to expand radially as it is forced up and over the outer surface 130 of the valve body 80. In its contracted position shown in FIG. 15 against the travel stop 138, the stop ring 136 protrudes inwardly sufficiently to contact the upper edge 140 of tubular 90. With contact established between the stop ring 136 and the tubular 90, the seal 128, which has a chevron shape in cross-section as shown in FIG. 15, has one lip 142 up against the outer surface of the tubular 90 with the other lip 144 in sealing contact with the sub 132. A bottom ring 146 is secured to the sub 132 at thread 148. A retainer ring 150 extends between the two lips 142 and 144 to hold the seal 128 in position and to act as a travel stop when the stop ring 136 contacts it, as shown in FIG. 14. The stop ring 136 has a surface 152 which allows it to be pushed radially out of the way when it contacts the lower end of the valve body 80. In the event that the thread 88 needs to be made-up to the tubular 90, the stop ring 136 has to be pushed radially out of the way. This happens when the shoulder 154 (see FIG. 11) contacts surface 152 to urge the stop ring 136 from the position shown in FIG. 15 to the position shown in FIG. 14. Surface 156 on the stop ring 136 is designed to catch the top 140 of the tubular 90 so as to properly position the seal 128 on the outer periphery of tubular 90 for a seal therewith.

The significant components of the preferred embodiment shown in FIGS. 11–15 now having been described, its straightforward operation will be reviewed in more detail.

Figure 16:
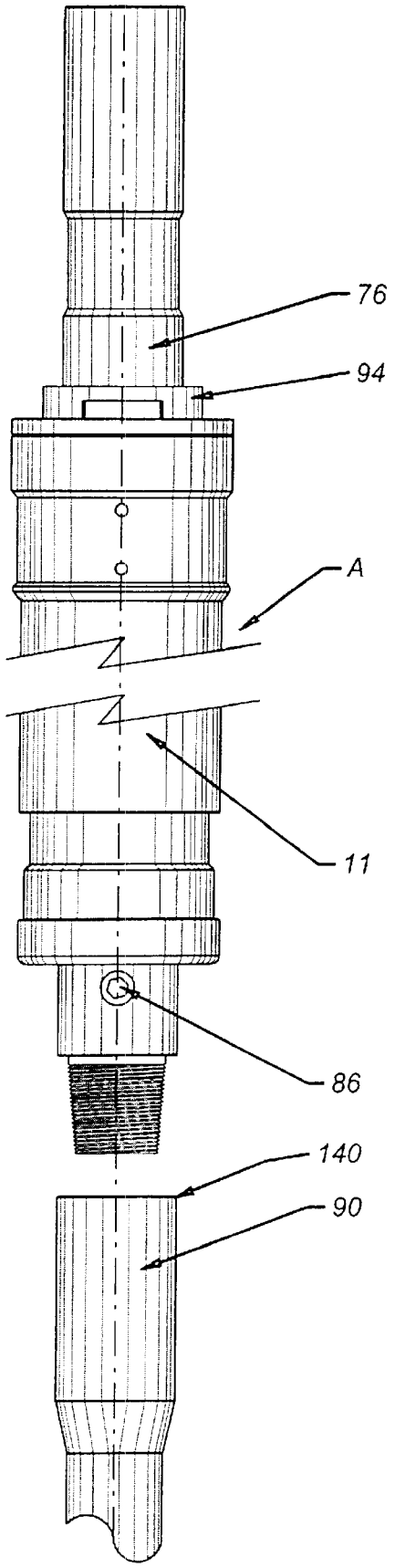
FIG. 16 is an external view of the device of FIG. 11, showing its position just before contact with the tubular.
Figure 17:
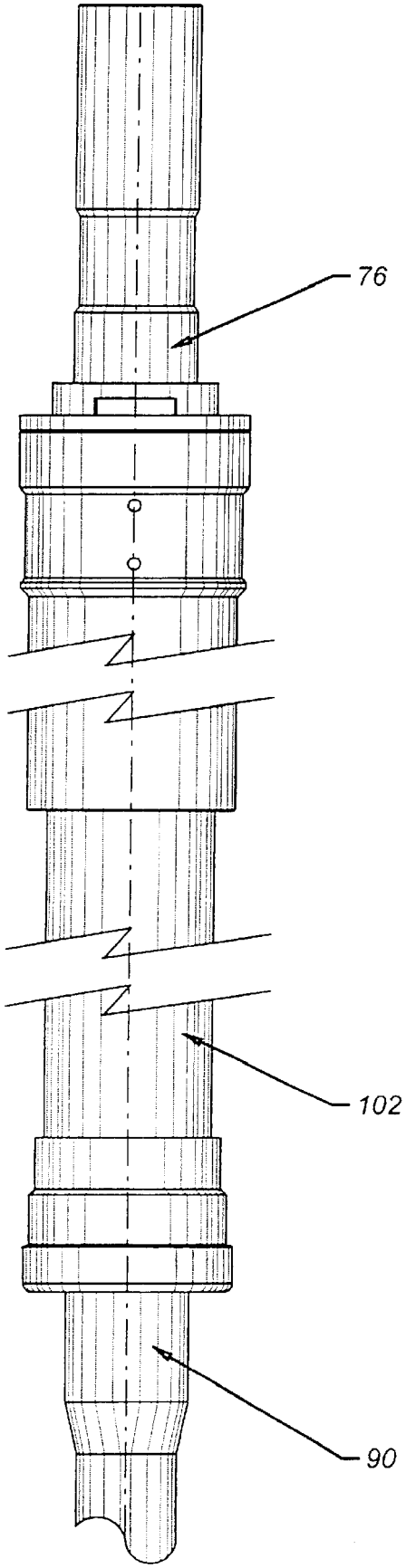
FIG. 17 is the view of FIG. 16, with the telescoping portion of the apparatus extended into contact with the tubular.

FIG. 16 illustrates the apparatus A suspended from a top drive (not shown) or otherwise supported in the derrick by body 76. The operating position of the assembly which includes the piston 102 can be adjusted by operation of the tab 94 to secure the assembly, including the inner sleeve 100, to a particular groove 92 on the body 76. That position has already been obtained in FIG. 16, and the tubular 90 is illustrated in position to accept the seal 128. Hydraulic pressure is applied to inlet 104 to begin the downward movement of the piston 102. It should be noted that there is no substantial difference between the apparatus in the position of FIG. 16 and in the position of FIG. 13, except that a lower groove 92 has been engaged in FIG. 13, putting the seal 128 below the hex connection 86, while in FIG. 16 the hex connection 86 is still exposed prior to actuating the piston 102. FIG. 17 illustrates the movement and extension of piston 102 so that the tubular 90 now has seal 128 engaged to its outer periphery. The tubular 90 can then be run in the well and returns will come up through the bore 78 of body 76. In the event of sudden rise in pressure in the wellbore, necessitating the connection of thread 88 to the tubular 90, the body 76 can be lowered to bring thread 88 into engagement with tubular 90 for make-up by actuation of a top drive. The piston 102 and all components connected to it will remain stationary, while the body 76 is lowered and rotated by a top drive (not shown) or manually by the rig crew.

Figure 18:
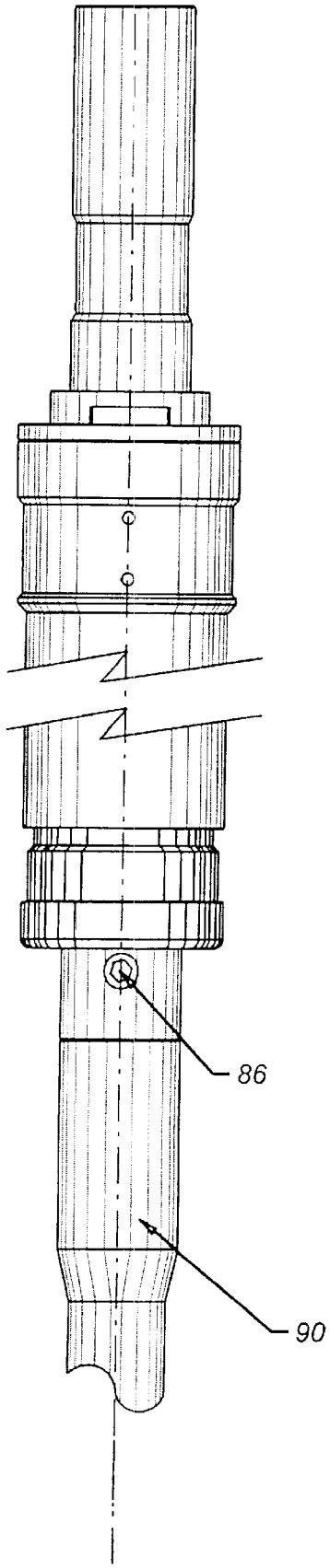
FIG. 18 is the view of FIG. 17, with the telescoping portion retracted sufficiently for manual operation of a shut-off valve and with the lower threaded connection secured to the tubular.
Figure 19:
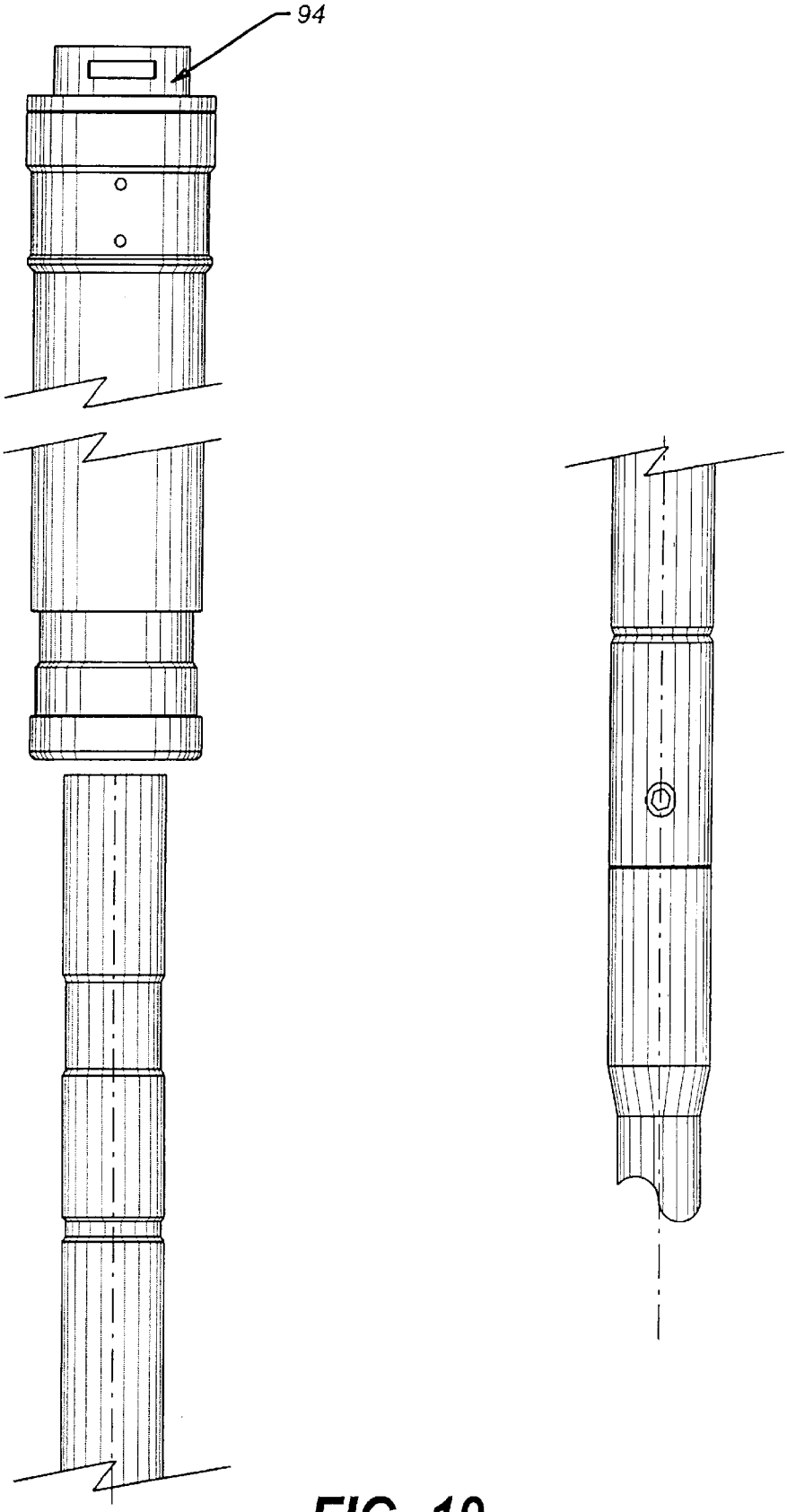
FIG. 19 is the view of FIG. 18, with the telescoping portion physically removed from the underlying hub.
Figure 20:
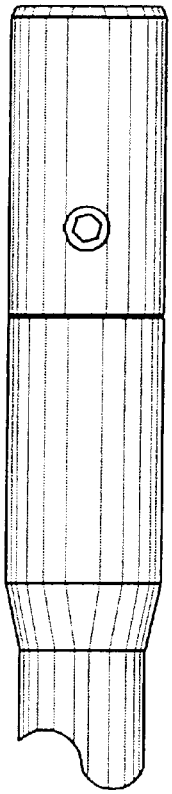
FIG. 20 is a detailed view showing the shut-off valve remaining on the tubular with the hub removed.
Figure 21:
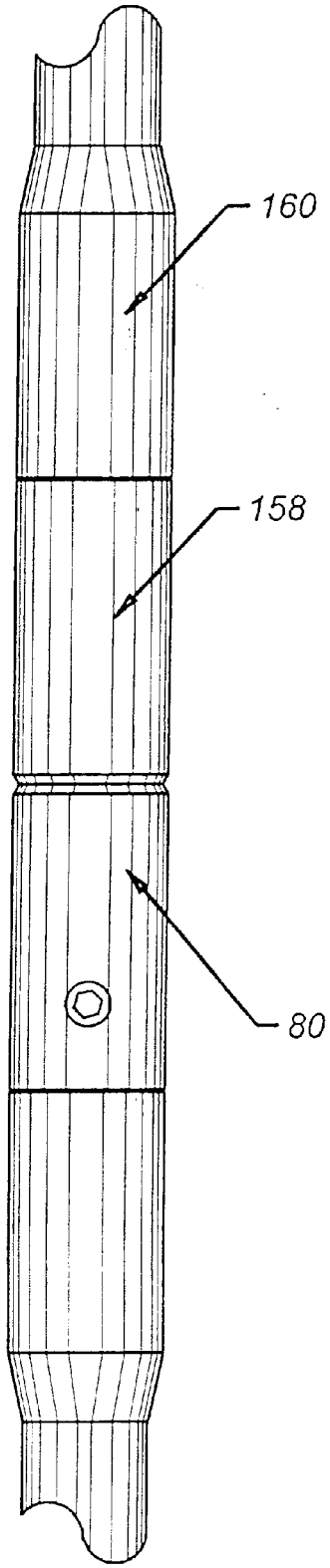
FIG. 21 is the view of FIG. 20, with a backpressure valve and pipe added above the shut-off valve and all screwed into the tubular below.

FIG. 18 shows the thread 88 fully engaged into the tubular 90 with the hex connection 86 exposed so that the ball 84 can be rotated 90° to be closed. FIG. 19 illustrates that the connection between the body 76 and the top drive has been released and the tab 94 has been pulled up to release the dogs 96 so that the inner sleeve 100 and everything attached to it can be removed from body 76. FIG. 20 illustrates that the body 76 has been removed from the valve body 80 by a disconnection at thread 82. FIG. 21 illustrates the addition of a backpressure valve 158 above the valve body 80, followed by pipe 160, which is in turn connected to a pressurized mud supply so that the well, if it is experiencing a surge in pressure, can be easily brought under control and all the connections can be secure, threaded connections when handling such an operation. Once the backpressure valve 158 is connected, the valve 84 can be rotated to the open position. Pipe can then be added to allow the pipe to be run into the wellbore to allow better control of the pressure surge or well problem.

Referring to FIGS. 22–25, the operation of the ball 84 can be automated. The valve body 80 can have a series of guide pins 162 which ride in a longitudinal track 164 to prevent relative rotation with respect to the piston 102. Piston 102 can have an operating pin 166. The ball 84 can have an operating plate 168 which has a groove 170 such that when the piston 102 is stroked downwardly, the pin 166 engages the groove 170 to rotate plate 168, thus putting the ball 84 in the open position shown in FIG. 22. Conversely, when the piston 102 is retracted, the pin 166 hits a different portion of the groove 170 to rotate the ball 84 in the opposite direction to the closed position shown in FIG. 25.

Figure 22:
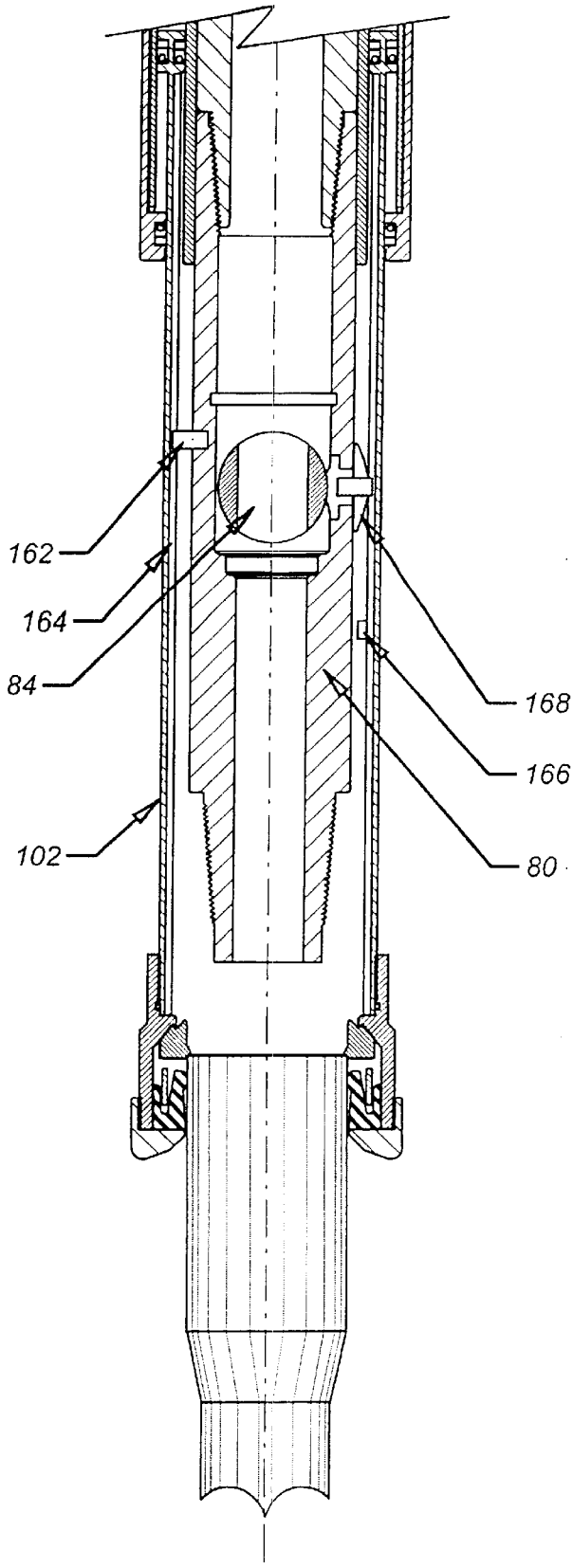
FIG. 22 is an alternative to FIG. 11, where the shut-off valve opens and closes automatically on shifting of the telescoping component.
Figure 23:
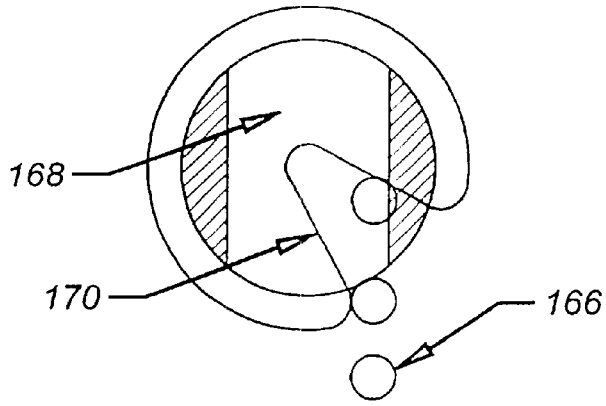
FIGS. 23 and 24 show how shifting the telescoping component opens and closes the valve in the hub.
Figure 24:
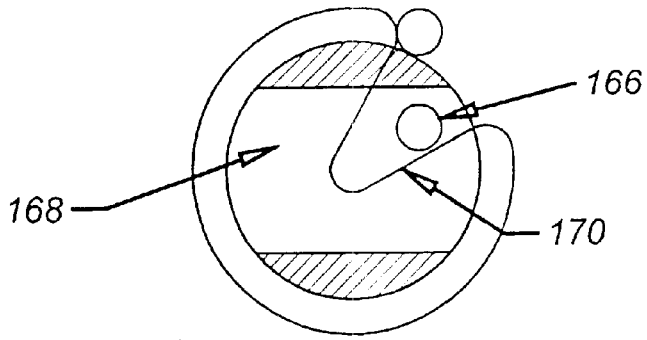
Figure 25:
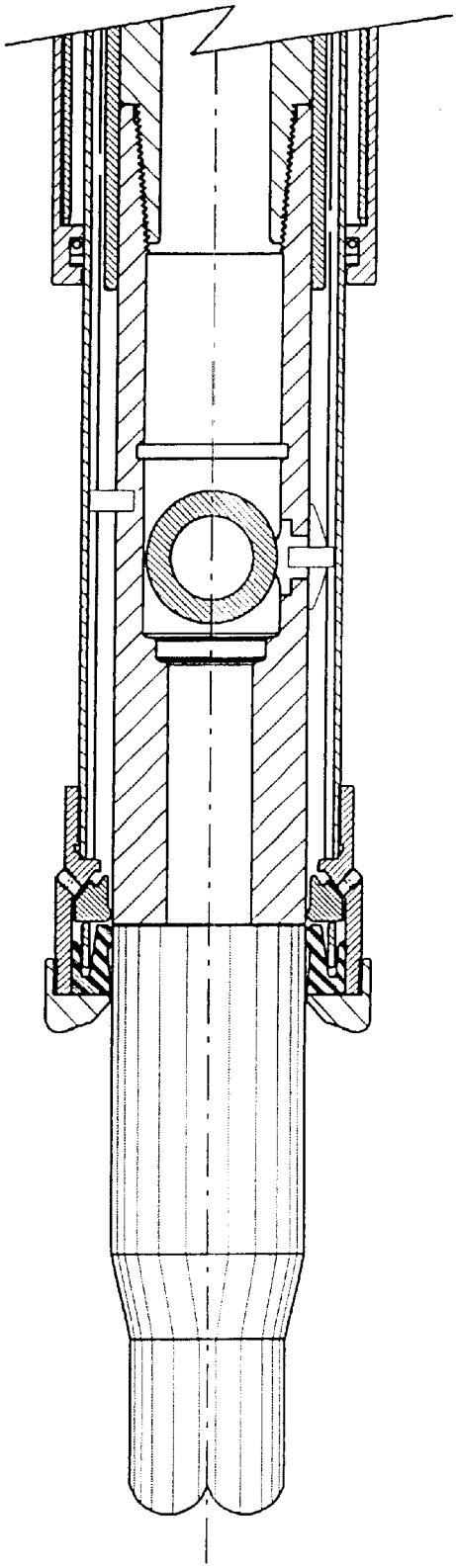
FIG. 25 is the view of FIG. 22, with the valve closed and the hub screwed into the tubular below.

Thus, the typical operation, whether the ball 84 is operated manually, as in FIG. 11, or automatically as in FIGS. 22 and 25, is to position the apparatus A close to a tubular 90. Piston 102 is extended with the ball 84 in the open position as shown in FIG. 11. Ultimately, seal 128 engages the outer surface of the tubular 90 and the stop ring 136 hits the top edge 140 of the tubular 90 and the seal is made up. Internal pressures in bore 78 further put a downward force on piston 102 to help hold seal 128 against the tubular 90. As the piston 102 is being extended, seal 128 passes flutes 126 and ultimately clears surface 152, at which time the stop ring 136 contracts radially to put itself in the position shown in FIG. 15 so that it may hit the top 140 of the tubular 90. The tubular 90 merely displaces lip 142 as the piston 102 is extended. Should the need arise to connect thread 88 to the tubular 90, the body 76 is lowered to the point where surface 154 engages surface 152 on the top ring 136 to push it out of the way by expanding it radially outwardly. The body 76 is further brought down and is rotated by a top drive or manually.

As to the embodiment shown in FIGS. 22 and 25, extension of the piston 102 actuates the ball 84 into the open position. There may be some minor spillage as the piston 102 extends further until seal 128 engages the tubular 90. On the reverse motion, lifting piston 102 may also cause some slight spillage until the pin 166 turns the plate 168 so that a 90° rotation of the ball 84 is completed to the position shown in FIG. 25, at which point leakage of mud will stop. The operation of ball 84 can be further automated to end the possibility of any spillage by assuring that the ball 84 is in the closed position before releasing the sealing grip of seal 128 against the outer surface of the tubular 90.

The advantage of the apparatus in the preferred embodiment illustrated in FIGS. 11–25 is readily seen. Previous inventions have required that the bore through the tubular be reduced and special space out and movement of the traveling block or top drive be incorporated into the operations while running or pulling tubulars. This device has a cylinder that extends to engage the tubular. The device may be located at different positions relative to the body 76 so that a variety of different situations can be addressed and the stroke of piston 102 is not a limiting factor. The piston 102 is shown to be driven hydraulically but can be driven by other means for obtaining a sealing contact on the outer periphery of the tubular 90. The use of the stop ring 136 allows accurate positioning each time adjacent the upper end 140 of the tubular 90 at its outer periphery. The positioning of the seal can be controlled by the relative location of the stop and seal so that the seal is always in the most desirable (clean/unmarked) portion of the tubular connection. Other techniques to position seal 128 can be used, such as a proximity switch or a load detector when the stop ring 136 lands on the tubular 90. Should there be a need to rigidly connect to the tubular 90, the body 76 can be lowered and the top drive engaged to drive body 76 to connect thread 88 to the tubular 90. As shown in FIGS. 16–21, the assembly from the inner sleeve 100 can be easily removed from the body 76 and a backpressure valve 158 and pipe 160 can be further added so that there is a hard pipe connection to the tubular 90 and the tubular string below for control of a high-pressure situation from the wellbore. It is also an advantage of the invention that additional joints of tubular can be added to the string to allow the tubular to be run to any depth in the well to allow fluid to be pumped to the deepest position in the well for well control purposes. The tubular can then re run into the well under control.

When in the automatic operation, the movements of the ball 84 can be coordinated with the movements of the piston 102 so as to close off the bore 78 in body 76 when the piston 102 is retracted and to open it when the piston 102 is being extended. The flutes 126 prevent liquid lock when trying to retract the piston 102 because there can be no sealing connection against the outer surface 130 of the valve body 80 in the area of the flutes 126. Thus, the piston 102 can be fully retracted without trying to compress a trapped area of liquid just inside the piston 102 and outside the valve body 80. Those skilled in the art will appreciate that the stop ring 136 can be constructed in a number of configurations and can be made from numerous materials, including metals and nonmetals, depending on the well conditions. The significant feature of the stop ring 136 is that it works automatically to reduce its inside diameter so that it contacts the top of the tubular 140, while at the same time having sufficient surfaces for engagement by the surface 154 to be pushed out of the way or radially expanded to allow the thread 88 to advance into the tubular 90 for proper make-up.

Figure 26:
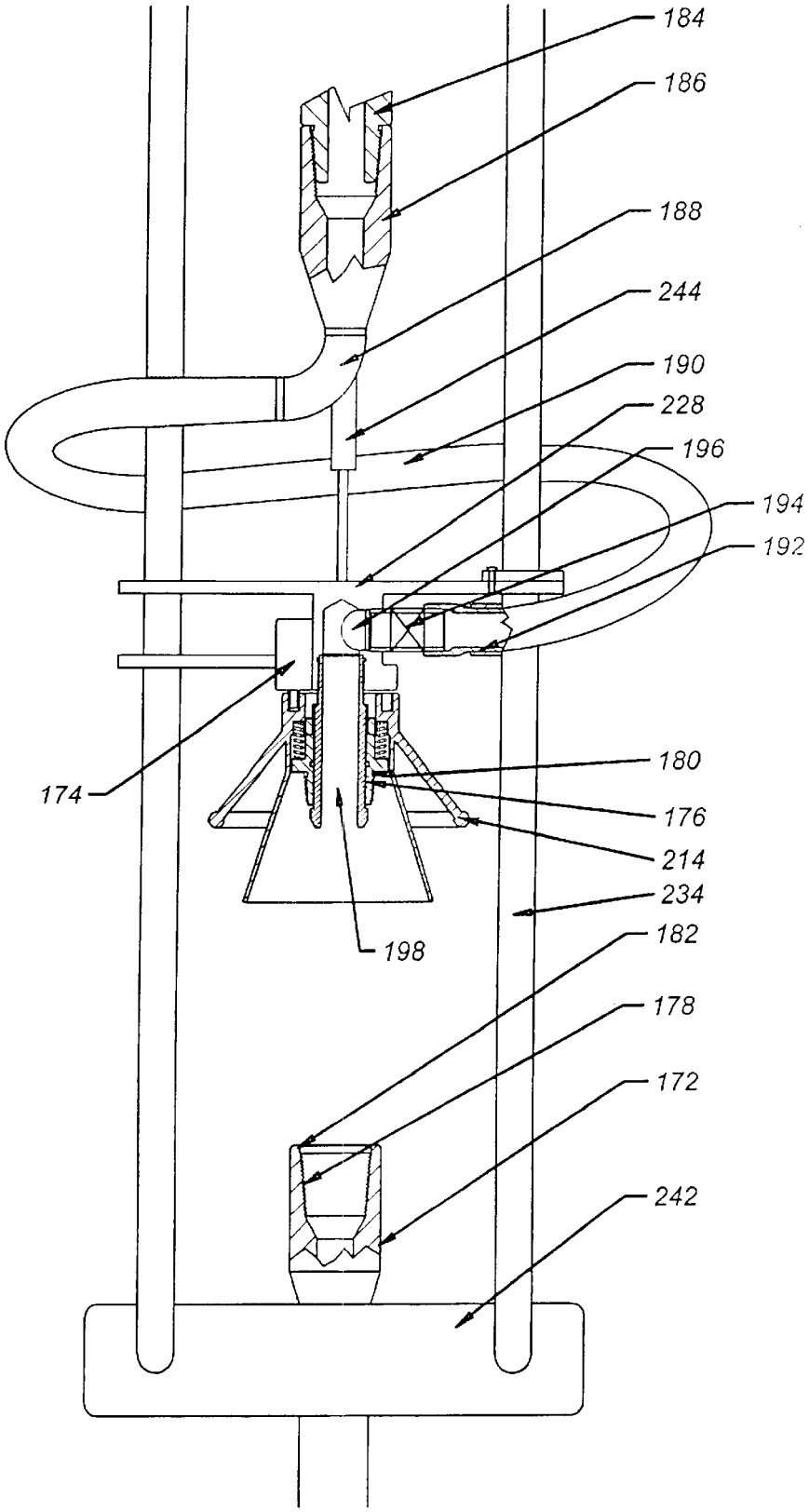
FIG. 26 is yet another alternative embodiment where the apparatus is retracted above a pipe supported in the elevator.

Referring now to FIGS. 26–37, yet another embodiment of the apparatus A of the present invention is disclosed. In this version, the system in its normal retracted position is "out of the way" and the apparatus A is power-driven to connect to a tubular 172 by virtue of a drive motor 174 which connects a thread 176 into a mating thread 178 of the tubular 172. Ultimately, a seal 180 engages just above the thread 178 at surface 182 in the tubular 172. The overall assembly is best seen in FIG. 26, where a top drive 184 is connected to a mud hose fitting 186 which is, in turn, connected to a swivel elbow 188 and ultimately to a mud hose 190. Hose 190 is connected by a swivel coupling 192 to an on/off valve 194. On/off valve 194 is, in turn, connected by a fitting 196 into fluid communication with passage 198, which is to be inserted into the tubular 172.

Figure 34:
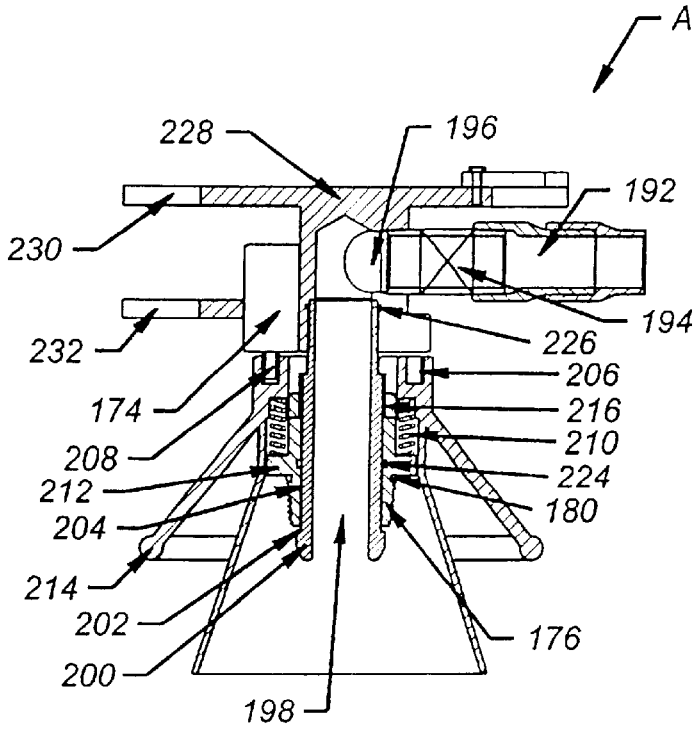
FIG. 34 is a detailed view of the apparatus as shown in FIG. 26.
Figure 35:
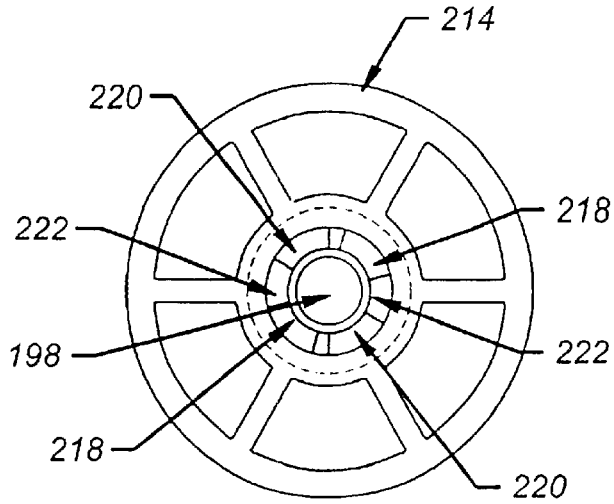
FIG. 35 is a detail of the handwheel for manual operation of the apparatus.

The details of the apparatus can be more clearly seen in FIG. 34, where it can be seen that the tube 200, which defines bore 198, has a support surface 202 to support the connector 204 on which threads 176 can be found. The handwheel 214 has an internal gear 206 which is engaged to a pinion 208 which is, in turn, driven by a motor 174. Motor 174 can be electrical, hydraulic, air- or gas-operated or any other kind of driver. A spring or springs 210 place a downward force on the connector 204 at its external shoulder 212. Although different configurations are possible, those skilled in the art will appreciate that in FIG. 34, the pinion 208 actually drives the handwheel 214. Handwheel 214 is, in turn, splined to connector 204 at splines 216. The gear 206 is literally part of the assembly of the handwheel 214 in the embodiment illustrated in FIG. 34. The handwheel assembly 214 and connector 204 can be made unitary. However, looking at the spline assembly 216 in the plan view of FIG. 35, it can be seen that the handwheel assembly 214 has a pair of lugs 218 which fit between lugs 220 on the connector 204. There are, thus, gaps 222 for the purpose of allowing initial movement of the handwheel assembly 214 before it engages the lugs 220 to assist in breaking loose thread 176 from the tubular 172 when a manual operation of handwheel 214 is required. It can be appreciated by those skilled in the art that two motors can be used, one for tightening the connection and the other for loosening the connection, and these motors could have Bendix drives for disengaging the gears when not in operation. This would be preferred when it is necessary to operate the system manually by turning the handwheel.

Figure 36:
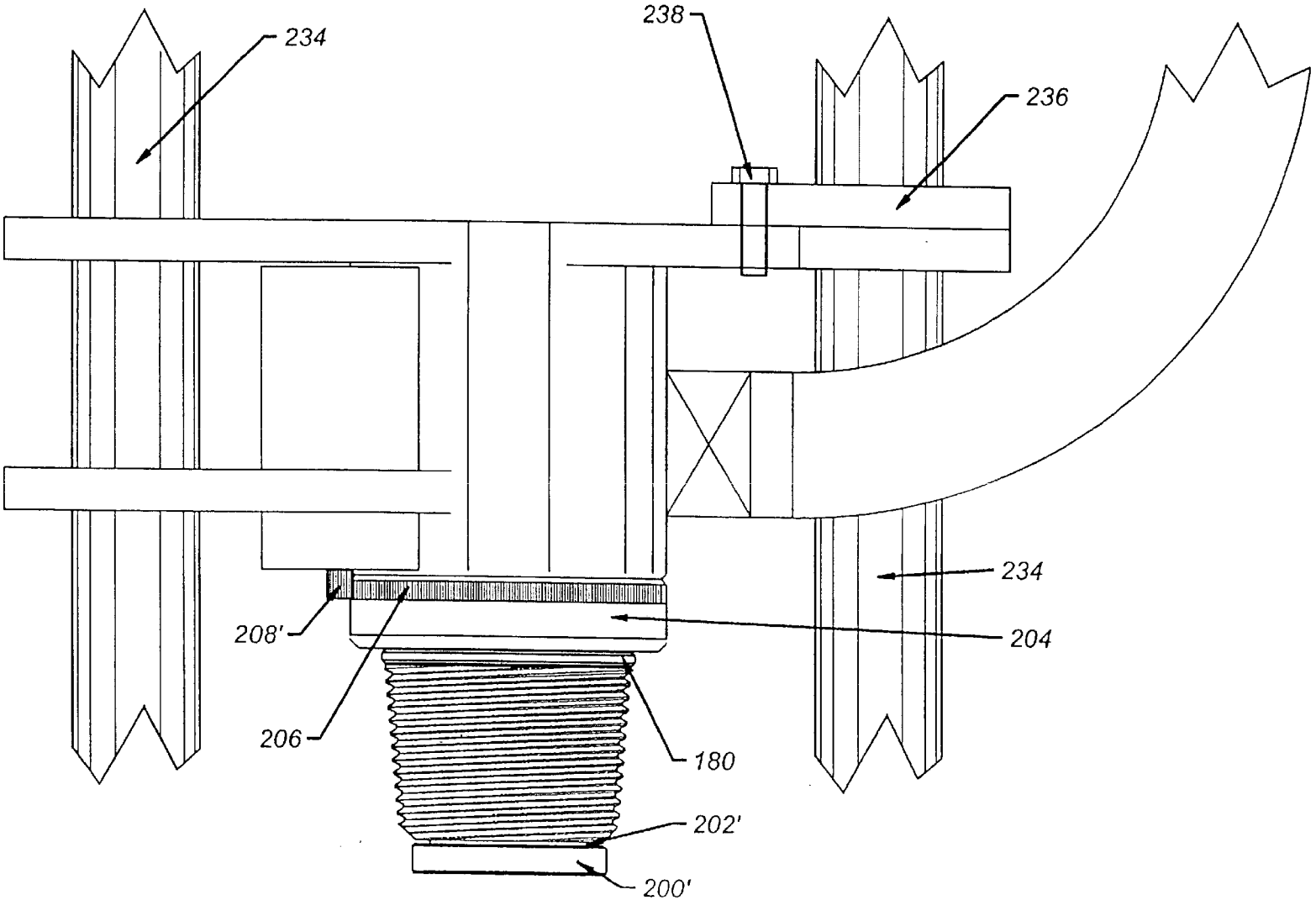
FIG. 36 is an alternative to the gear drive design shown in FIG. 34.

FIG. 36 illustrates an alternative arrangement having an accessible pinion 208' engaged to a gear 206'. Here, the assembly is in one piece and it holds a seal 180'. The connector is supported by a tube 200' which has at its lower end a surface 202' to support the connector 204'. In all other ways, the version of FIG. 36 operates identically to the version in FIG. 34.

Referring again to FIG. 34, seal 224 seals between the connector 204 and the tube 200. Another seal 226 is toward the upper end of tube 200 to seal to fitting 196. Accordingly, there is full swivel action for the hose 190 due to swivel elbow 188 on one end and a swivel connection at its other end at coupling 192. Additionally, the fitting 196 allows rotation about the vertical axis of tube 200 with respect to fitting 196.

Referring to FIG. 34, the apparatus A is suspended on a frame 228. Frame 228 has aligned openings 230 and 232 on two sides, each pair accepts a bail 234, as shown in FIG. 36. The frame 228 can have open-ended cutouts to accept the bails 234, or it can use a closure member 236 secured by a fastener 238, as shown in FIG. 36 on the right-hand side. In an alternative embodiment, the frame 228 supporting the apparatus A can be made so that its center of gravity is at a point different than between the bails 234 so that its mere weight holds the apparatus against the bails and prevents it from swinging through or between the bails. Doing it in this manner will provide a coarse alignment for the apparatus A with the tubular 172, but it will not control side-to-side movement between the bails.

Figure 37:
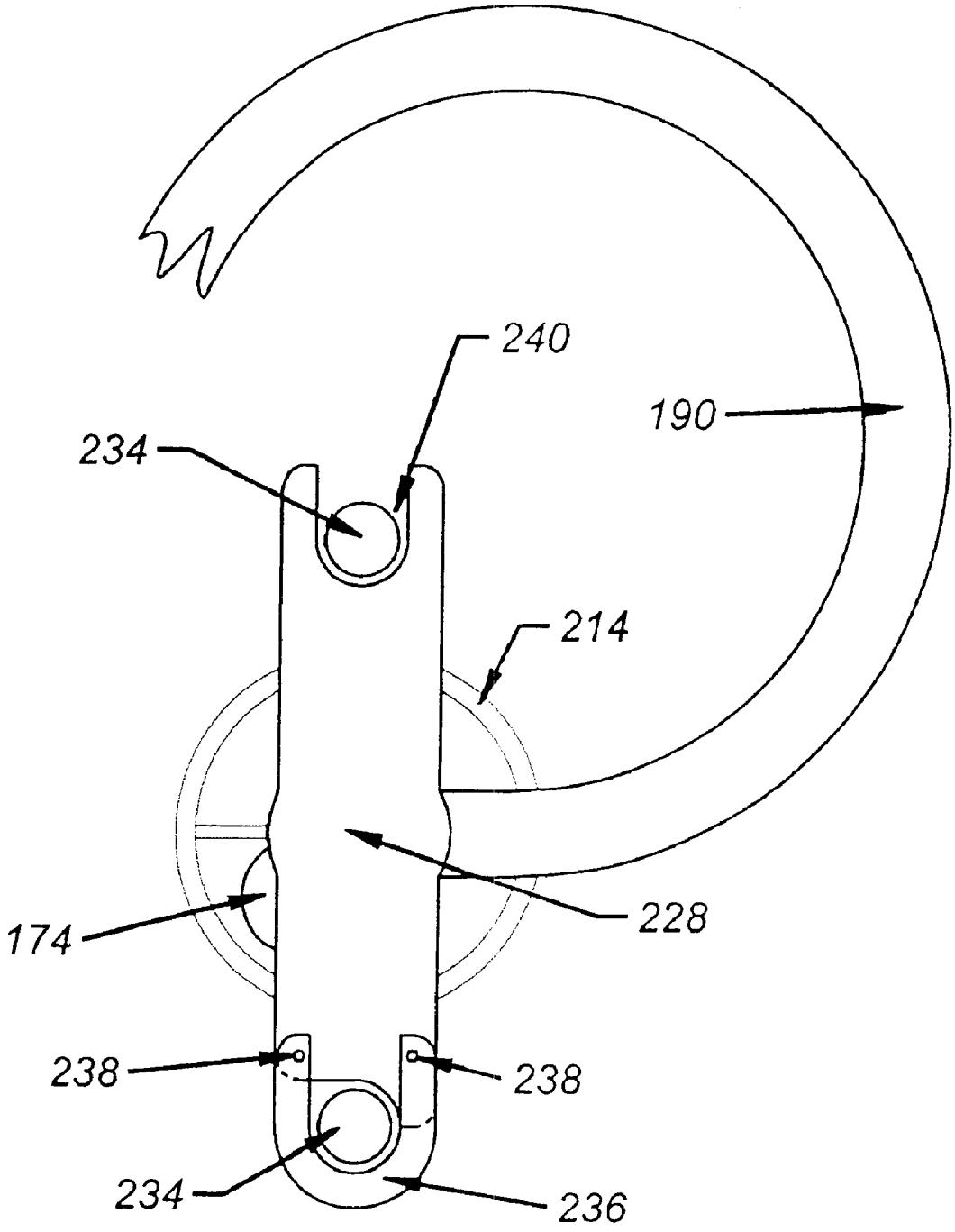
FIG. 37 is a top view of the apparatus as shown in FIG. 34 or 36.

The details of how the frame 228 is securable to the bails 234 are seen in FIG. 37. There, it will be appreciated that on one end, there is a U-shaped opening 240 which is moved into position to straddle one of the bails 234, while the closure device 236 is secured with fasteners 238, fully around the other bail 234.

Figure 27:
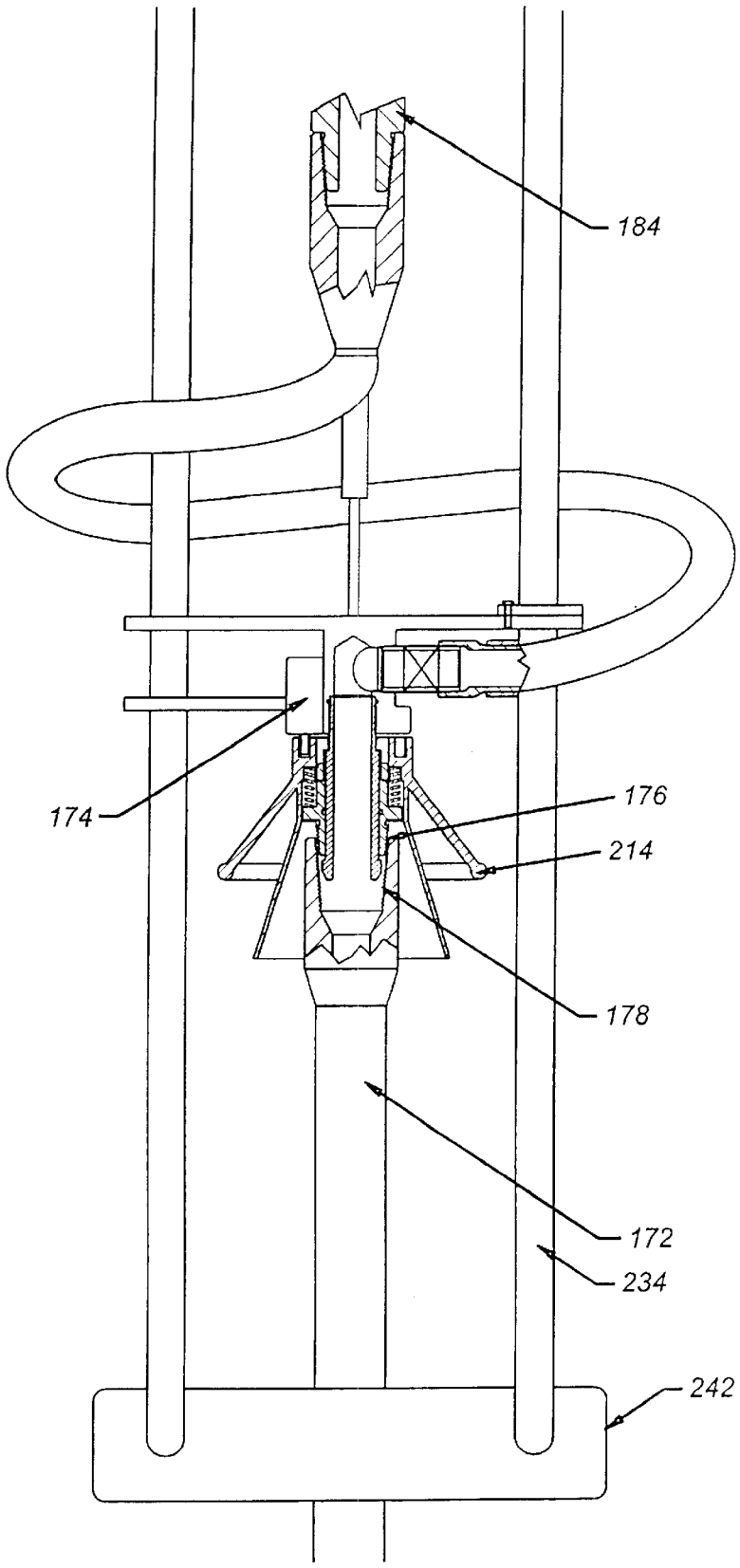
FIG. 27 shows the apparatus brought into contact with the tubular as the top drive is lowered and prior to final make-up.
Figure 28:
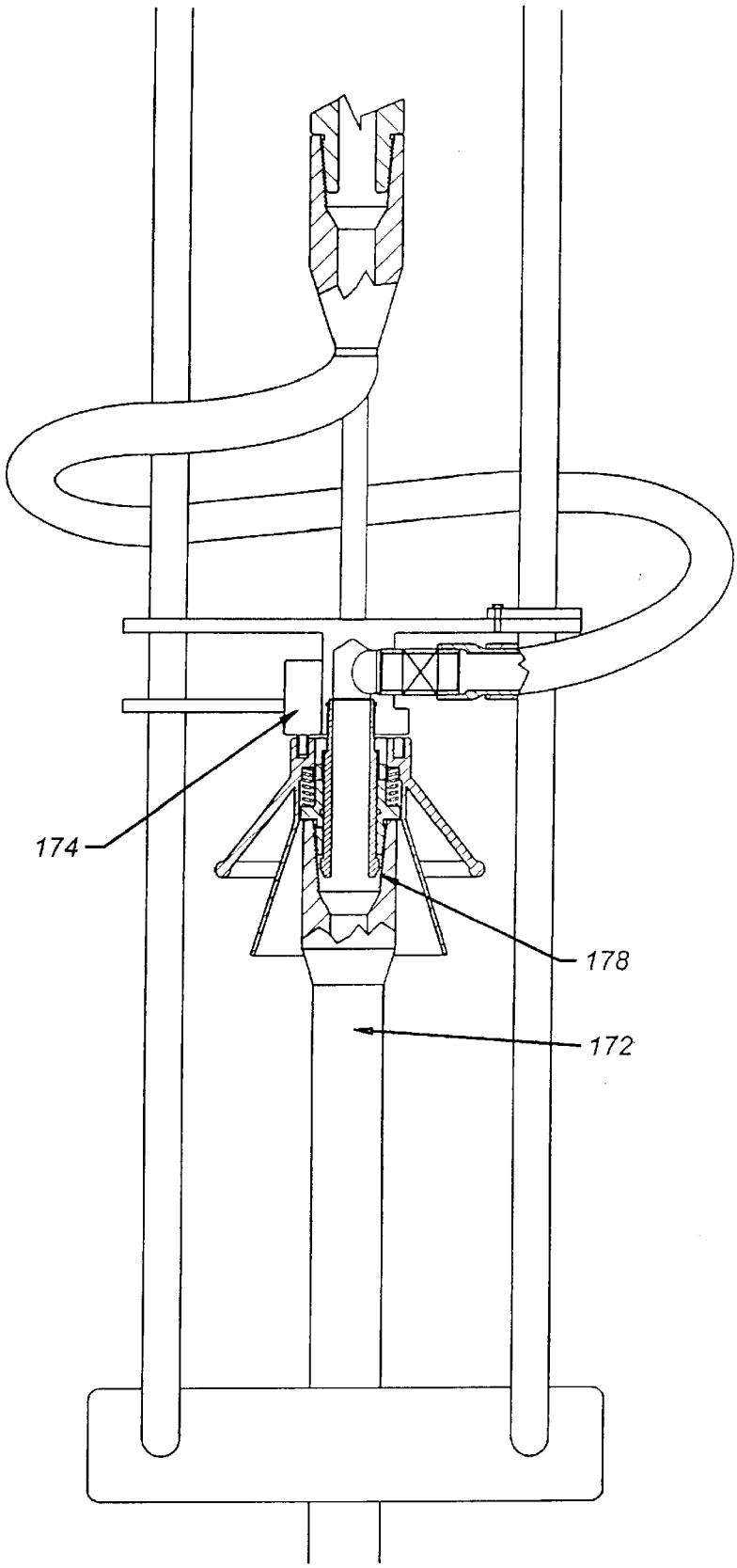
FIG. 28 is the view of FIG. 27, with the thread made up.
Figure 30:
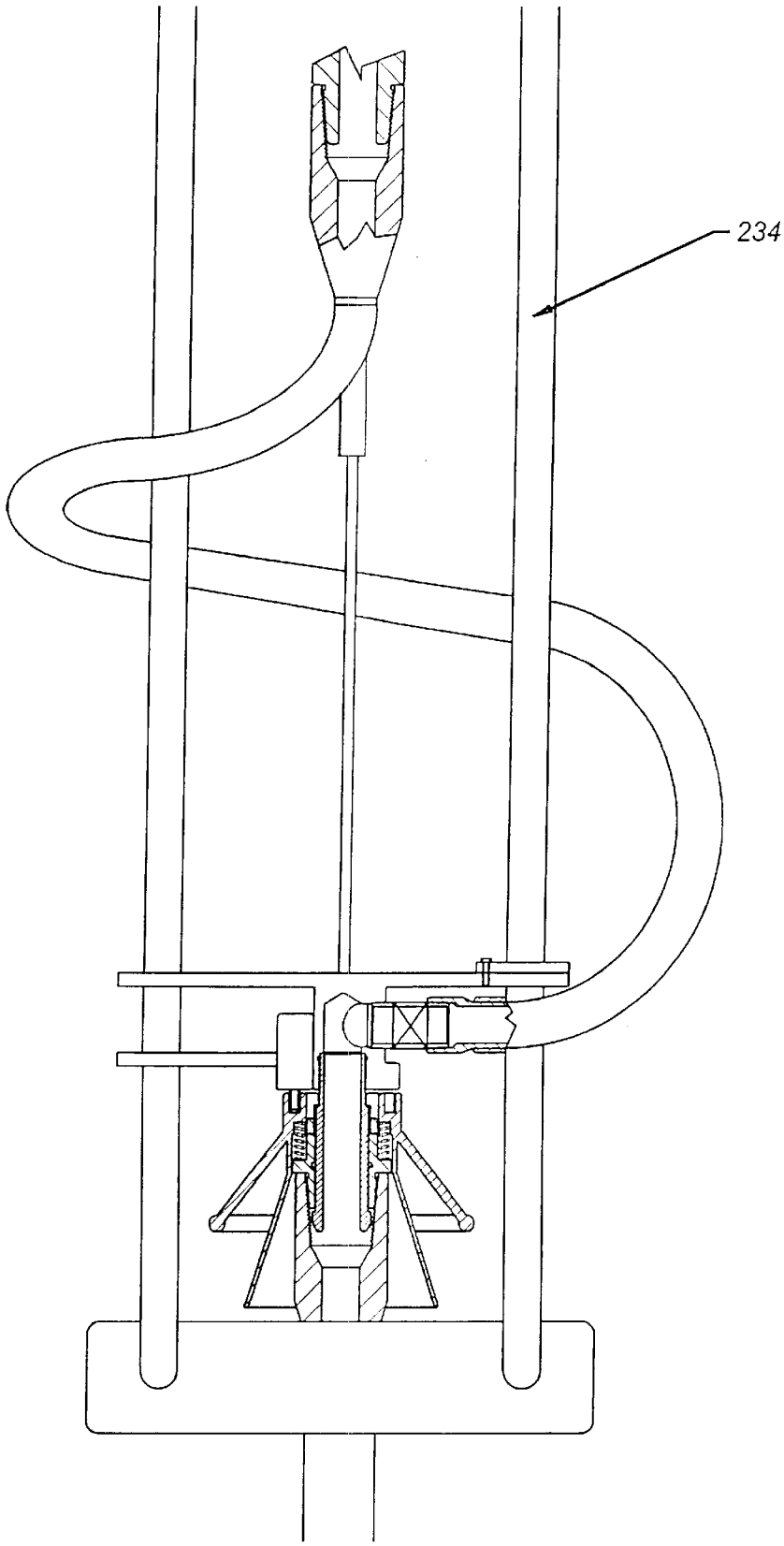
FIG. 30 is the view of FIGS. 28 and 29 after thread make-up and the pipe supported by the elevators.

Referring again to FIG. 26, it will be seen that the elevator 242 has engaged the tubular 172. The frame 228 can be suspended from the top drive 184 by different types of mechanisms which can either affirmatively move the frame 228 with respect to the bails 234 or alternatively which suspends the frame 228 using the bails 234 as guides and depends on operator assistance to position the apparatus A so that the thread 176 can engage the thread 178. Thus, item 244 can be a piston/cylinder combination or a spring which suspends the weight of the apparatus A from the top drive 184. As seen in FIG. 26, it is desirable to have the apparatus A out of the way so that the tubular 172 can be hooked into the elevator 242. Having engaged the tubular 172 in the elevator 242, it is desirable to bring the apparatus A into proximity with the tubular 172 to make up thread 176 to thread 178. This can be accomplished in various ways, as shown in FIGS. 27, 28 and 30. In FIG. 27, the top drive 184, along with the bails 234 and elevator 242, can be brought down with respect to the tubular 172 which remains stationary because it has already been secured to the tubular below it (not shown). The tubular below it is supported in the rig floor with slips. The threads 176 and 178 are brought close together prior to engagement of the seal 180. As shown in FIG. 28, the final movement to get the threads 176 and 178 together can be accomplished by operation of the motor to drive the threads together and fully engage the seal 180. The top drive 184, bails 234 and elevator 242 can then be raised to allow the tubular 172 to be picked up by the elevators 242.

Figure 29:
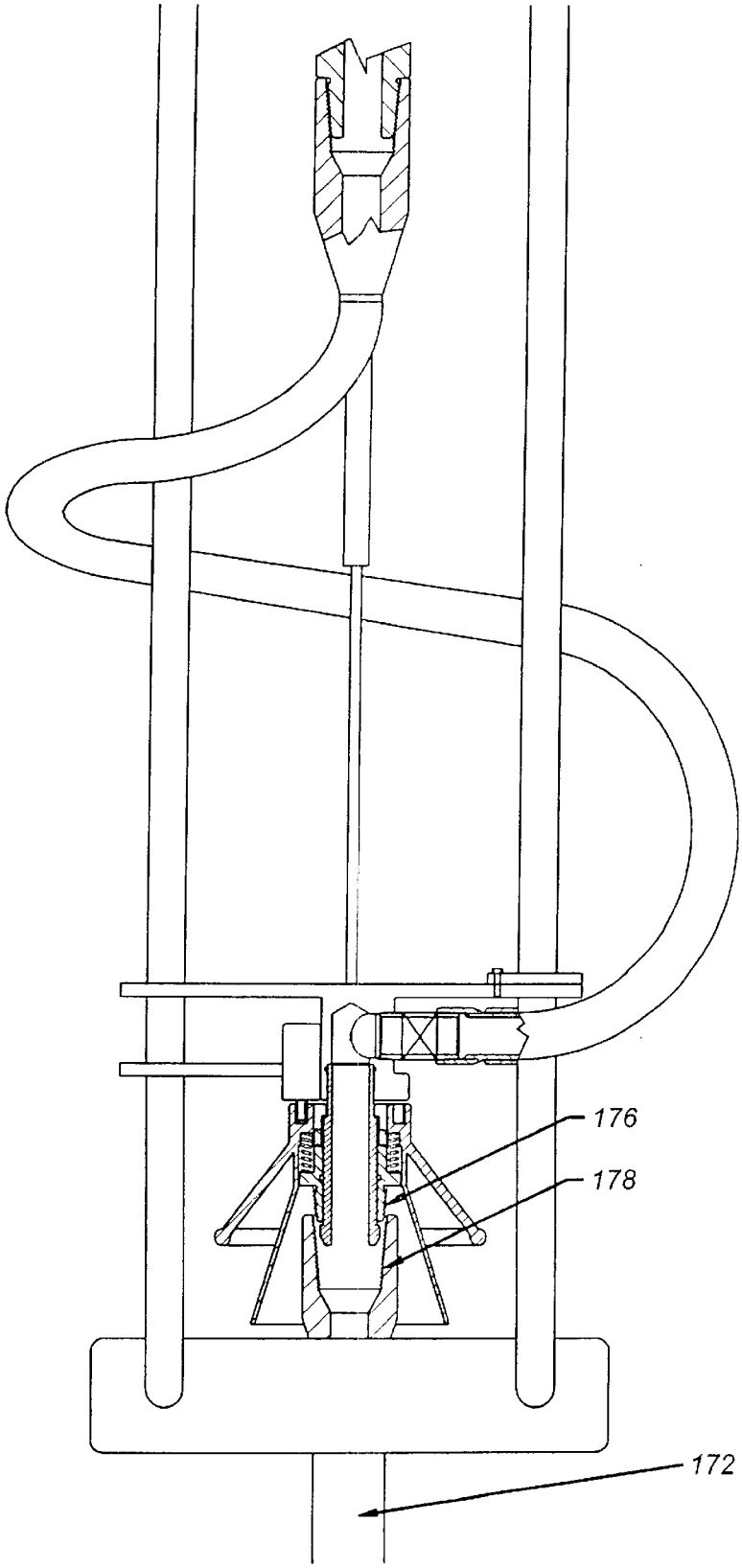
FIG. 29 is similar to FIG. 27 except that the apparatus is supported by telescoping pistons and cylinders as opposed to a spring-like device prior to thread make-up.
Figure 31:
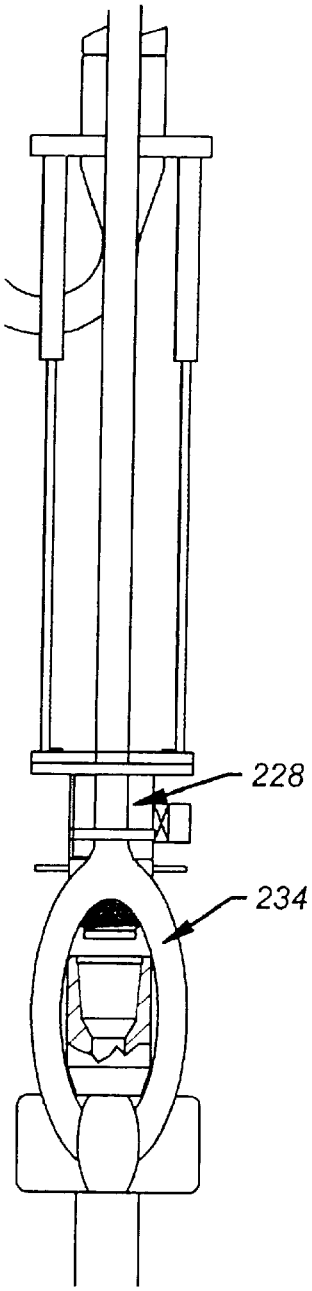
FIG. 31 is a side view of FIG. 26, showing the device being guided by the bails and attachment of cylinders or springs.
Figure 33:
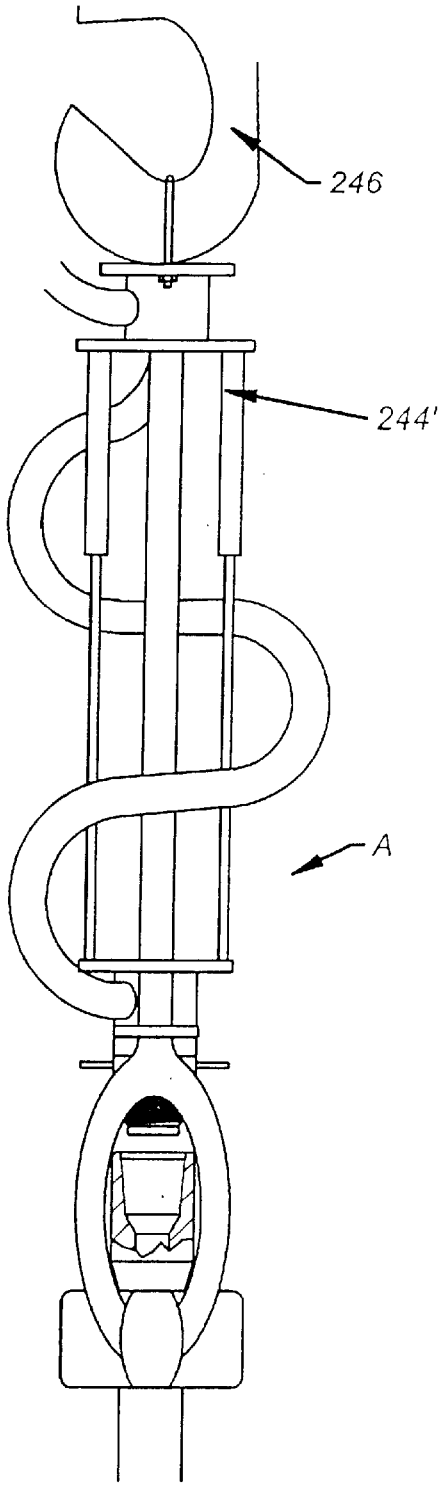
FIG. 33 is a side view of FIG. 32.

An alternate method is illustrated in FIGS. 29 and 30. FIG. 29 indicates that the apparatus A can be pulled down to bring threads 176 close to threads 178 so that the motor 174 can be operated to complete the joint. The completed joint from the position shown in FIG. 29 is shown in FIG. 30. FIG. 31 shows a side view of FIG. 26 to illustrate how the bails 234 guide the frame 228.

Figure 32:
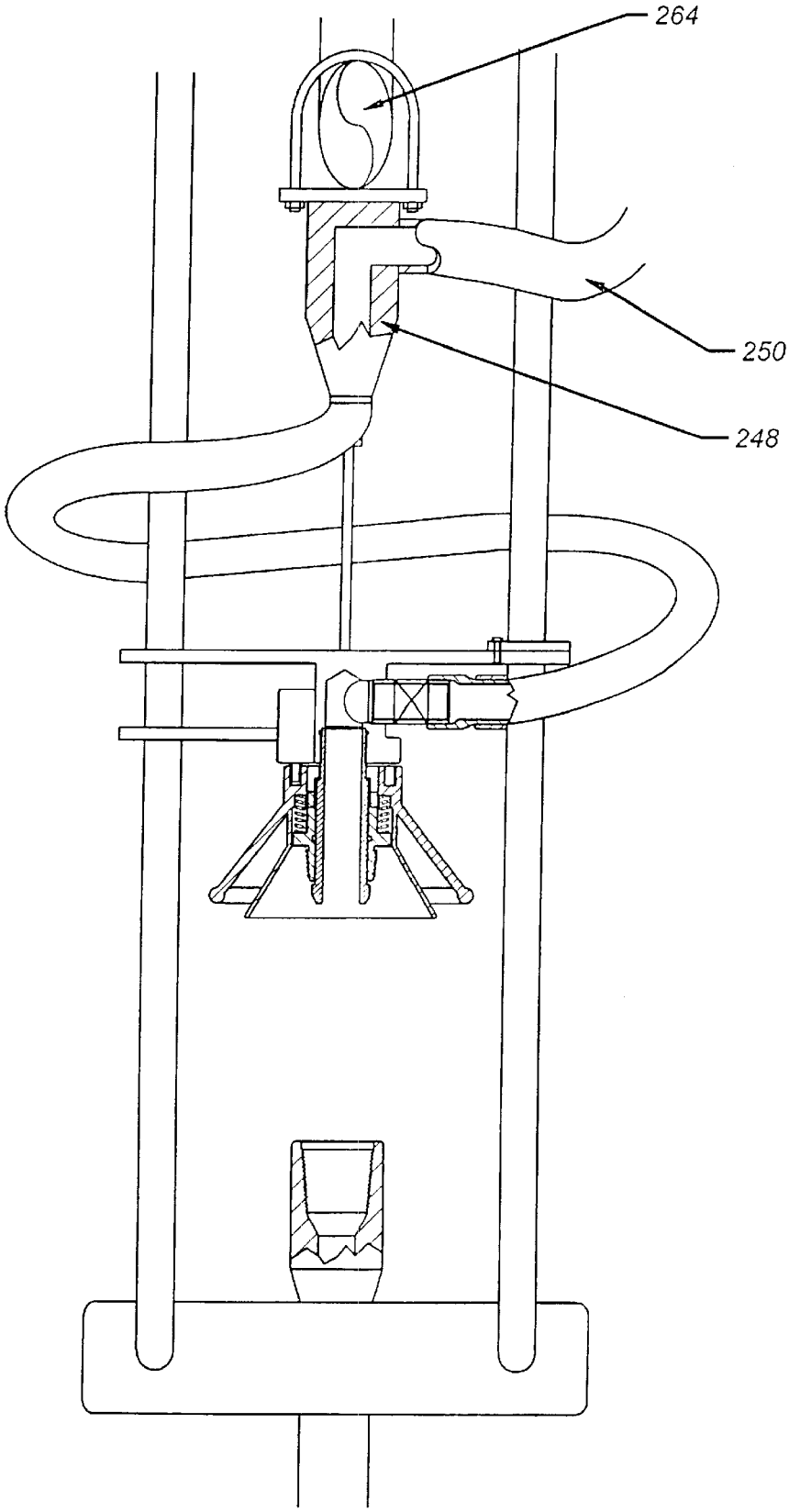
FIG. 32 is an alternative embodiment which is supported by a hook when there is no top drive available.

FIG. 32 shows an alternative to FIG. 26 where there's no top drive available. In that situation, a hook 246, better seen in the side view of FIG. 33, supports a swivel fitting 248. A mud supply hose 250 is connected to the rig mud pumps (not shown). The balance of the assembly is as previously described. Again, the apparatus A can be supported by a piston/cylinder assembly or springs 244' to keep the apparatus A when a tubular 172 is being engaged in the elevators 242 and thereafter to allow the apparatus A to be brought closer to the tubular 172 to connect thread 176 to thread 178, as previously described.

Those skilled in the art will appreciate that the advantages of the preferred embodiment are its simplicity, full bore, positive-sealing engagement, and ease of operation. The seal 180 engages a well-protected portion of the tubular connection for a more positive sealing location. The apparatus A stays out of the way to allow a tubular 172 to be easily engaged in the elevator 242. Thereafter, the apparatus A can be brought into operating position, either by a piston/cylinder assembly. Alternatively, the weight of the apparatus A can be supported off a spring and an operator can grab the handwheel 214 to overcome the weight of the suspended apparatus A and pull it down to begin engagement of thread 176 into thread 178. Various alternative power supplies can be used to turn the connector 204 to complete the engagement. Once the tube 200 is secured into the tubular 172, the valve 194 can be opened so that the tubular 172 can either be put into the wellbore or pulled out.

When going into the wellbore, the displaced fluid through bore 198 returns to the mud tanks on the rig. When pulling out of the hole, fluid is made up from the mud pumps (not shown) through the bore 198 and into the tubular 172 being pulled out of the hole to facilitate rapid removal from the wellbore. As previously stated, when running tubulars into tight spots in the wellbore, the displaced fluid will come up through the tubulars into bore 198 and needs to be returned to the mud pits to avoid spillage at the rig. Conversely, when pulling tubulars out of the wellbore, fluid needs to be pumped in to replace the volume previously occupied by the tubulars being pulled to avoid resistance of the fluids to removal of the tubular. Thus, in this embodiment, each joint can be readily connected and disconnected to the apparatus A for quick operations in running in or pulling out tubulars from the wellbore. Furthermore, in the event of a pressure surge in the well, all the connections are hard-piped to allow rapid deployment of the rig mud pumps to bring the pressure surge situation in the wellbore under control. In those situations, valve 194 can also be closed and other assemblies installed in lieu of or in addition to hose 190 to aid in bringing the unstable situation downhole under control. Hose can be connected to a mud scavenging or suction system. It can be appreciated by those skilled in the art that a safety valve as described in the apparatus of FIG. 11 can be attached below the thread 176 having a seal similar to 180, thereby allowing complete well control as described for the apparatus of FIG. 11.

Referring now to FIGS. 38–45, an alternative embodiment to the preferred embodiment previously described is discussed. In this embodiment, rotation is not required to lock the apparatus A to the tubular. Instead, a locking device allows the apparatus to be simply pushed into the tubular for locking therewith as well as for a sealing connection which allows the addition of mud or the receipt of mud, depending on the direction of movement of the tubular.

Figure 38:
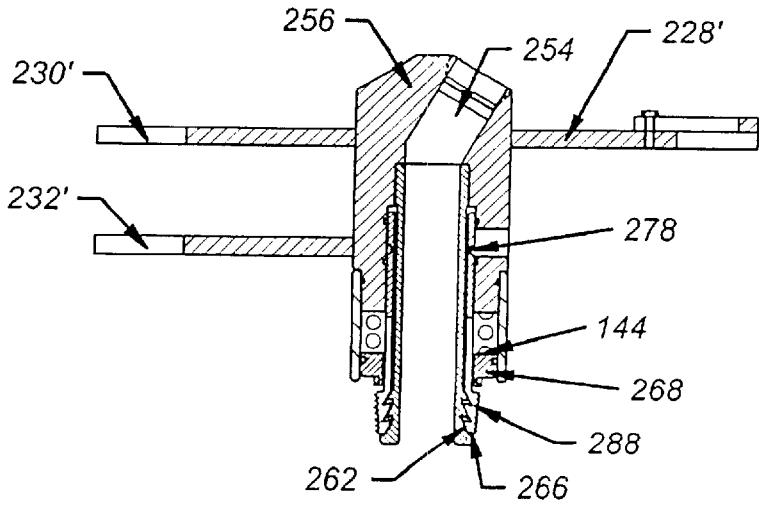
FIG. 38 is a detailed of an alternative technique for engaging a tubular with the apparatus where rotation is not required.
Figure 39:
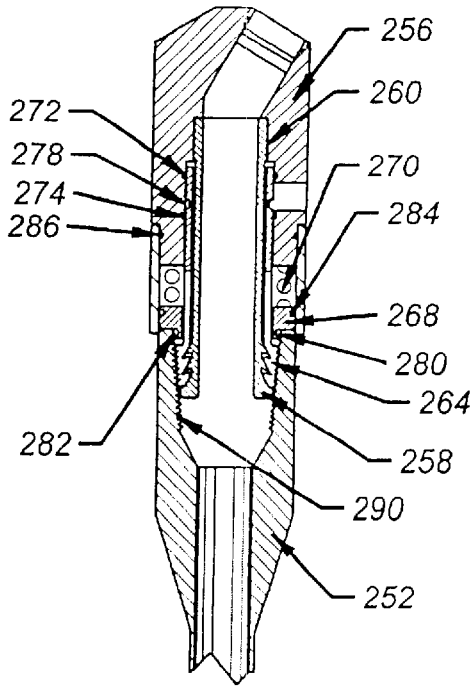
FIG. 39 is a detailed view showing how the engagement and sealing portion operates without rotation.

Referring now to FIGS. 38 and 39, the embodiment which allows the connection to be made up by simply pushing in the apparatus A into a tubular 252 is disclosed. As before, a frame 228' has aligned openings 230' and 232' to engage the bails (not shown). A mud hose (not shown) is connected to connection 254 and may include a valve (not shown). The mud hose (not shown) is connected into a housing 256. Secured within housing 256 is locking member 258, which is held to the housing 256 at thread 260. A series of downwardly oriented parallel grooves 262 are present on the locking member 258. A locking collet 264 has a series of projections 266 which are engageable in grooves 262. A piston 268 is biased by a spring 270 off of housing 256 to push down the collet 264. Since the locking member 258 is fixed, pushing down the collet 264 ramps it radially outwardly along the grooves 262 of locking member 258 for engagement with a tubular 252, as shown in the final position in FIG. 39. Seals 272 and 274 seal around opening 276. A groove 278 is accessible through opening 276 for release of the apparatus A by insertion of a tool into groove 278 and applying a force to drive the collet 264 upwardly with respect to locking member 258, thus moving projections 266 within grooves 262 and allowing the apparatus A to be retracted from the tubular 252. A seal 280 lands against surface 282 in the tubular 252 for sealing therewith, as shown in FIG. 39. Another seal 284 is on piston 268 to prevent loss of drilling mud under pressure which surrounds the spring 270 from escaping onto the rig floor. Similarly, seal 286 serves the same purpose.

Those skilled in the art will appreciate that in this embodiment, the apparatus A is simply brought down, either with the help of a rig hand lowering the traveling block or by automatic actuation, such that the collet 264, which has an external thread 288, can engage the thread 290 in the tubular 252. This occurs because as the apparatus A is brought toward the tubular 252, the piston 268 is pushed back against spring 270, which allows the collet 264 to have its projections 266 ride back in grooves 262 of the locking mechanism 258. The spring 270 continually urges the seal 280 into sealing contact with the mating tubular surface. Upon application of a pickup force to the housing 256, the locking mechanism 258 along with its grooves 262 cam outwardly the projections 266 on the collet 264, forcing the thread 288 into the thread 290 to secure the connection. At that time, the seal 280 is in contact with the internal surface 282 of the tubular 252 to seal the connection externally. Those skilled in the art will appreciate that internal pressure in bore 292 will simply urge the locking member 258 in housing 256 away from the tubular 252, which will further increase the locking force on the collets 264, and that the internal pressure will also urge piston 268 into contact with the tubular member 252, maintaining sealing engagement of seal 280. As a safety feature of this apparatus, in order to release this connection, the pressure internally in bore 292 needs to be relieved and a tool inserted into slot 278 so that the collets 264 can be knocked upwardly, thus pulling them radially away to release from the thread 290 on tubular 252. Sequential operations of a valve on the mudline (not shown) can be then employed for spill-free operations on the rig floor. Essentially, once the connection is made as shown in FIG. 39, the valve on the mudline is opened and the tubular 252 can be run into or out of the hole. The connection is then released as previously described by use of groove 278. As in the other embodiments, the full bore is maintained.

Figure 40:
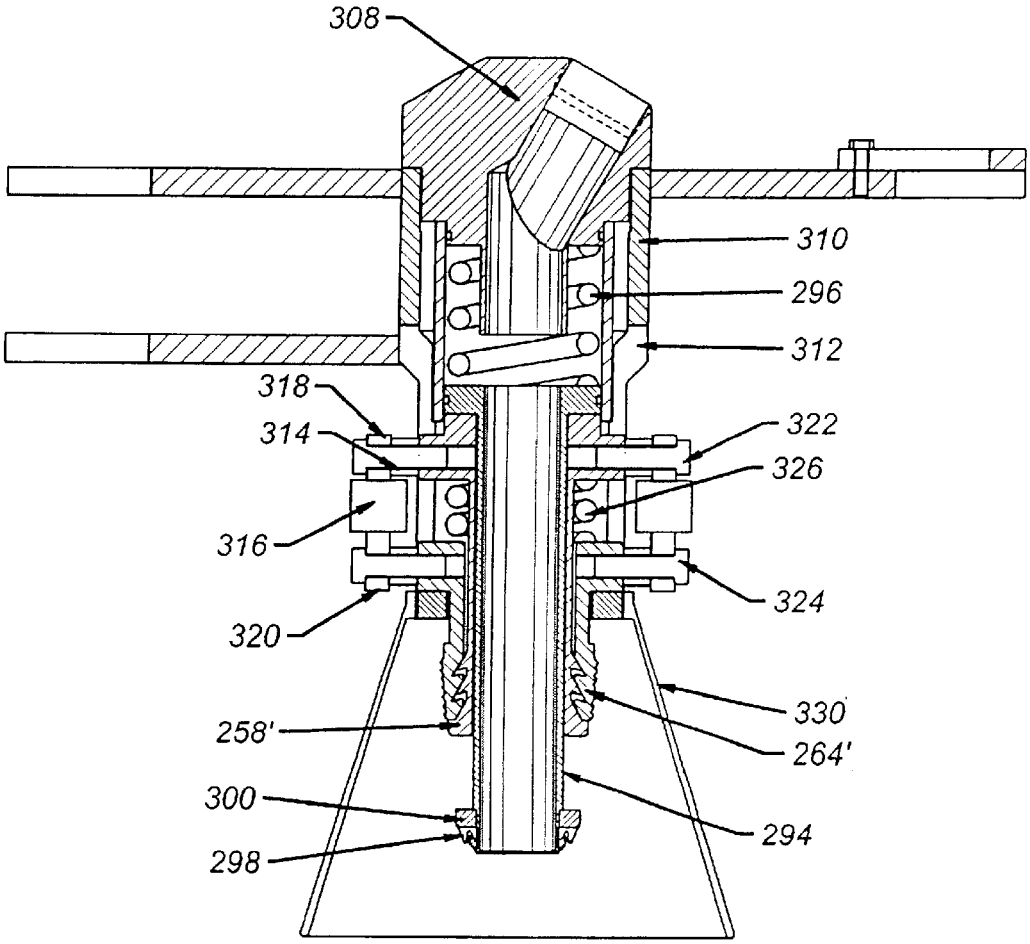
FIG. 40 is an alternate assembly of a more automated alternative to that shown in FIG. 38, showing not only the thread engagement and releasable portion but also the sealing tube feature of the apparatus.
Figure 41:
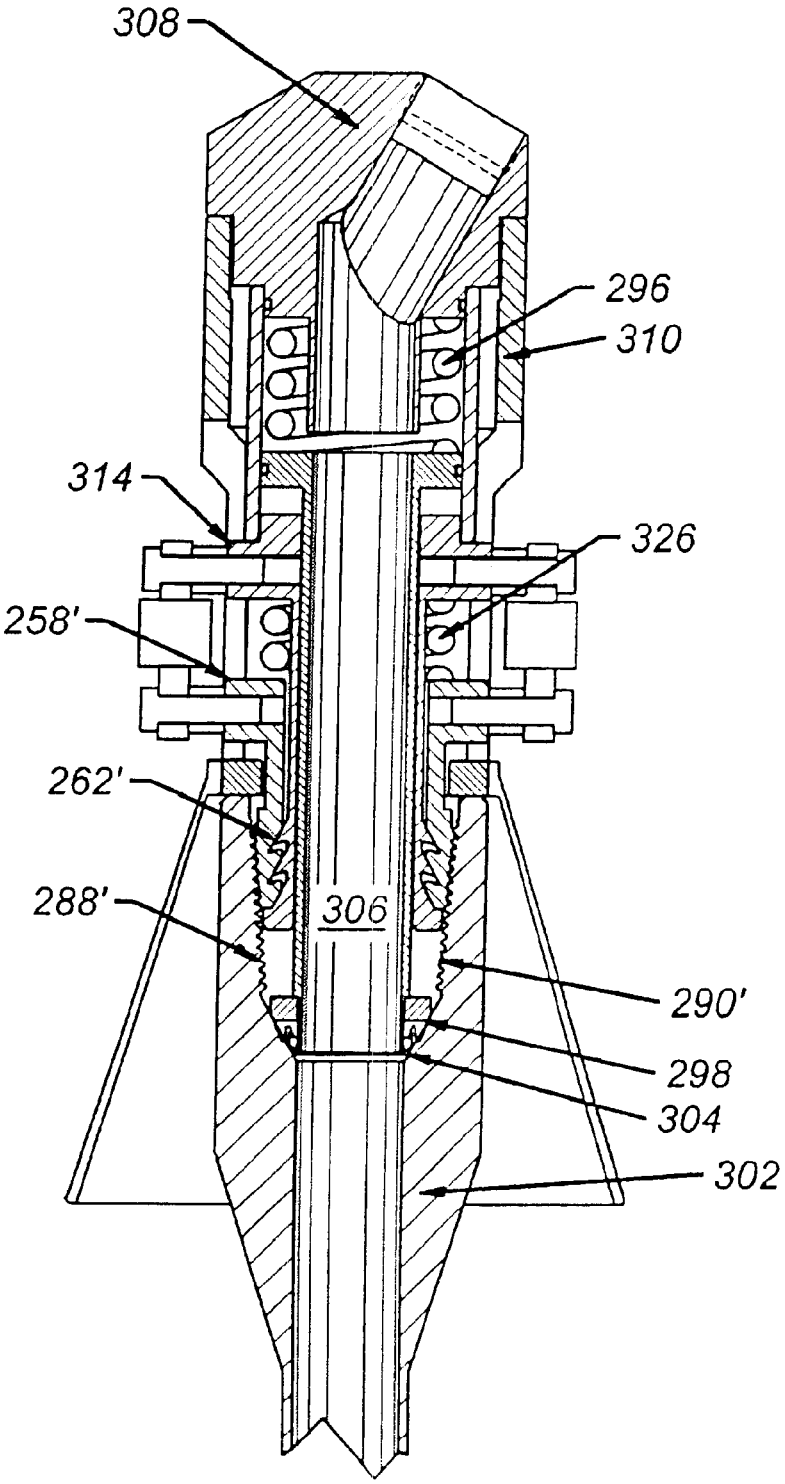
FIG. 41 is a complete apparatus incorporating the details of FIG. 40, showing engagement into a tubular.

There may be difficulty in getting the connection shown for the apparatus A in FIGS. 38 and 39 to release through the use of a tool applied on groove 278. Accordingly, the next embodiment illustrated in FIGS. 40–45 can be employed to more fully automate the procedure. The principle of operation is similar, although there are several new features added. Where the operation is identical to that in FIGS. 38 and 39, it will not be repeated here. What is different in the embodiment of FIG. 40 is that there is a tube 294 which is now biased by a spring 296. At the lower end of tube 294 is a seal 298 which is preferably a chevron shape in cross-section, as shown in FIG. 40. An external shoulder 300 is used as a travel stop within the tubular 302 for proper positioning of the seal 298, as shown in FIG. 41. Thus, in this embodiment, the seal 298 engages surface 304 inside the tubular 302 for sealing therewith. Pressure in bore 306, in conjunction with the force from spring 296, keeps the tube 294 pushed down against the tubular 302. The other feature of this embodiment is that the locking and release is done automatically. Extending from the housing 308 is a frame 310 with a pair of opposed openings 312. Connected to locking member 258' is a plate 314. A motor 316 which can be of any type has shafts 318 and 320 extending from it which can be selectively extended or retracted. The shafts 318 and 320 are respectively connected to connections 322 and 324. Connection 324 extends out of or is a part of the collets 264'. A spring 326 forces apart plate 314 from the assembly which is the collets 264'.

Figure 42:
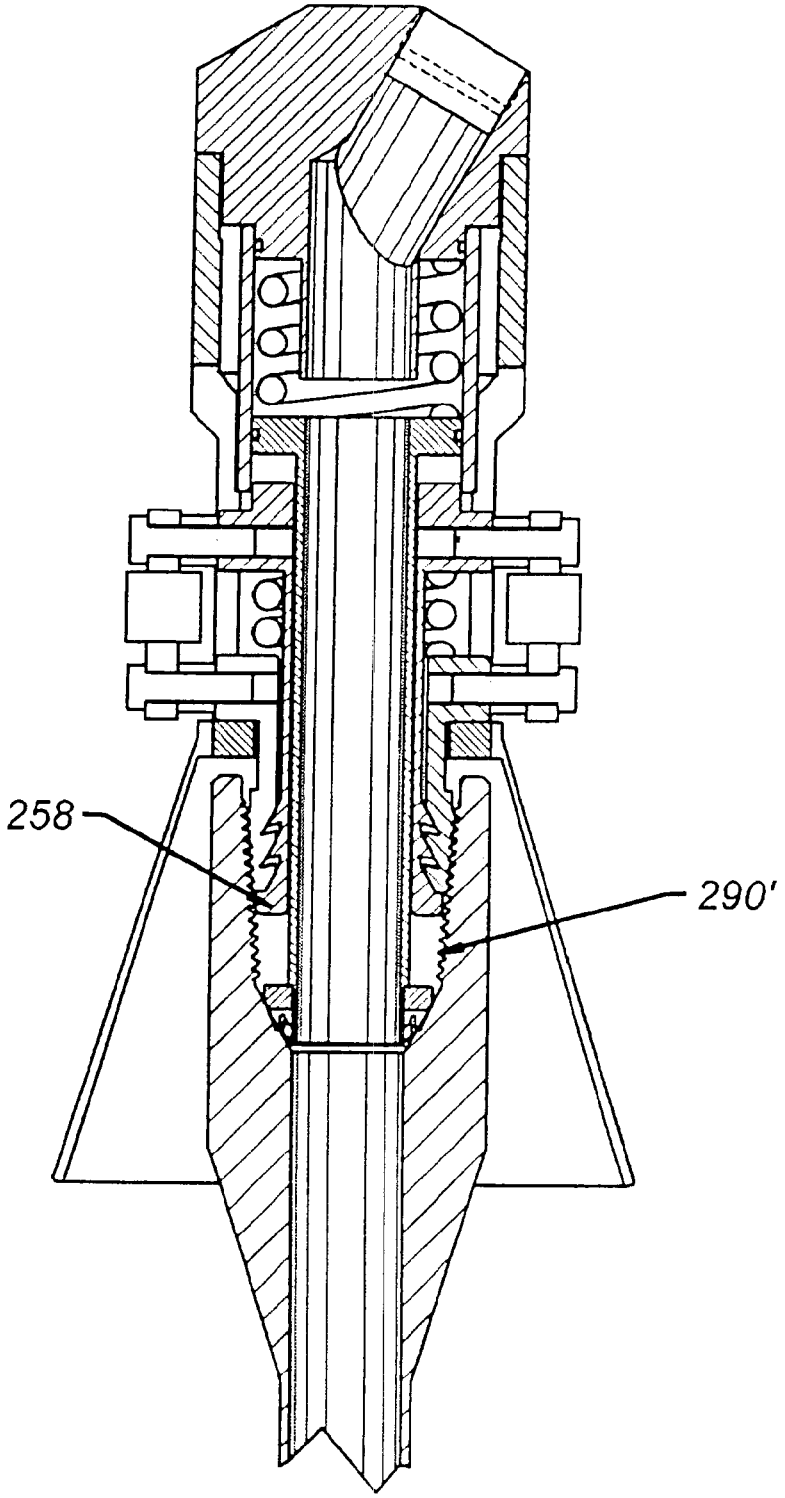
FIG. 42 shows the locked position of the apparatus shown in FIG. 40, with pressure applied internally.
Figure 43:
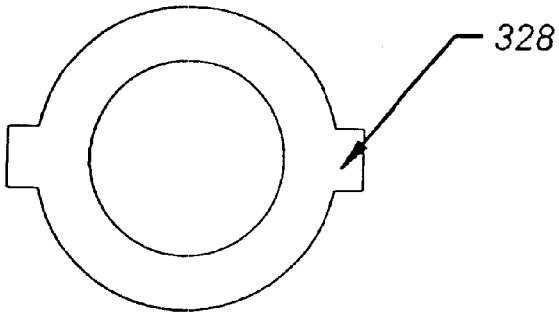
FIG. 43 is a detail of a component of the locking mechanism showing how it is guided by the apparatus.
Figure 44:
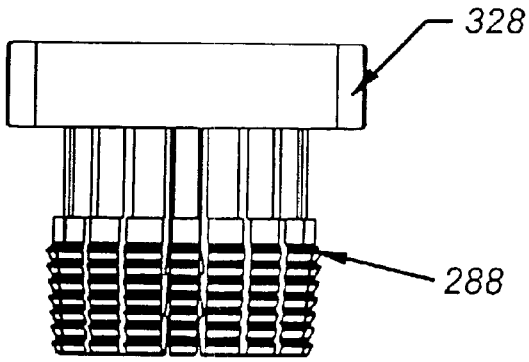
FIG. 44 is an elevational view of part of the locking mechanism for the apparatus.
Figure 45:
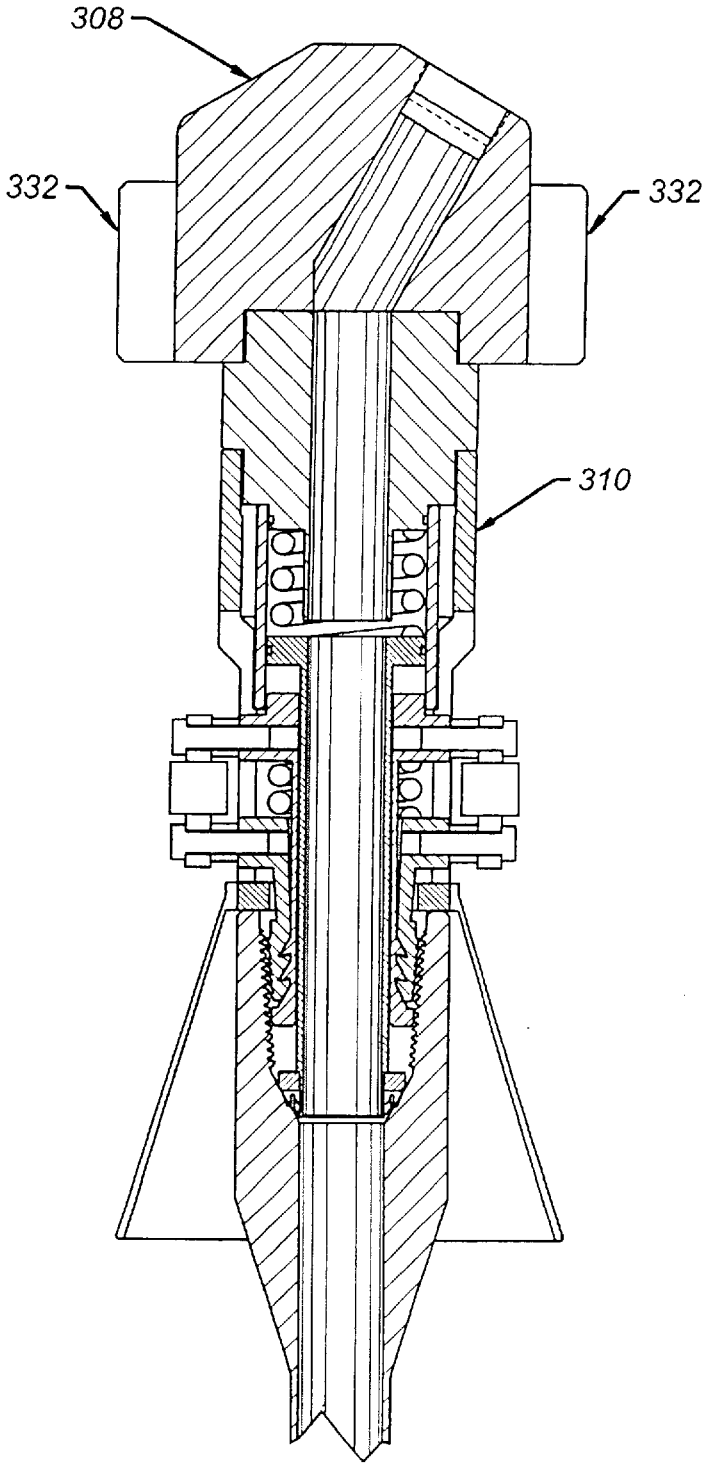
FIG. 45 is a view of the apparatus shown in FIG. 41 in the condition where it is released from the tubular below.

Those skilled in the art will appreciate that when it comes time to engage the apparatus A as shown in FIG. 40 into a tubular 302, the motor or motors 316 can be engaged to bring the plate 314 closer to the collet member 264' to thus retract the collet member 264' into the grooves 262' of the locking member 258'. This position is shown in FIG. 41, where the spring 326 is stretched as plate 314 is moved away from the collet assembly 264'. The collets with the thread 288' can now slip in and engage the thread 290 on the tubular 302. As this is happening, the spring 296 biases the tube 294 to engage the seal 298 onto surface 304. Thereafter, the motor or motors 316 are engaged to bring together the plate 314 from the collets 264', thus forcing the collets 264' to be cammed radially outwardly as the locking member 258 is forced upwardly by the motor or motors 316. The apparatus A is now fully connected, as shown in FIG. 42. The collet assembly 264' has a set of opposed dogs 328 shown in FIG. 43. These dogs 328 extend into openings or slots 312 to prevent relative rotation of the collet assembly 264' with respect to frame 310. A guide 330 is conical in shape and assists in the initial alignment over a tubular 302. The guide 330 is part of the frame 310 and the frame 310 lands on top of the tubular 302, as shown in FIG. 41. A more detailed view of the collet assembly 264', showing threads or grooves 288' which engage the thread 290 in the tubular 302, is shown in FIG. 44. FIG. 45 is similar to FIGS. 40–42, with the exception that the housing 308 is more readily removable from the frame 310 using lugs 332 which can be hammered onto make or release the joint between the housing 308 and the frame 310. In all other ways, the operation of the embodiment of the apparatus A shown in FIG. 45 is identical to that shown in FIGS. 40–42.

Those skilled in the art will appreciate that there are advantages to the embodiment shown in FIGS. 40–42 to that shown in FIGS. 38–39. By using one or more motors which separate and bring together parallel plates, the collets 264' can be placed in a position where they can be easily pushed into a tubular 302. Then by reverse actuating the motor and allowing the locking mechanism 258 to push the collet assembly 264' outwardly, the apparatus A is locked to the tubular 302 and seal 298, which can be any type of seal, seals around the tube 294 to accept returns or to provide mud, depending on the direction of movement of the tubular 302. Thus, by the use of the motor 316, which brings together and separates the plates 314, the outward bias on the collet assembly 264' can be controlled by a power assist which greatly speeds up the connection and disconnection to each individual tubular 302. As in previous embodiments, the full bore of the tubular is maintained.

The foregoing disclosure and description of the invention are illustrative and explanatory thereof, and various changes in the size, shape and materials, as well as in the details of the illustrated construction, may be made without departing from the spirit of the invention.

What is claimed:

1. A fill up and circulating tool to engage threads on a tubular, having a top end, for connection to a mud system comprising:

a body having a passage therethrough having a lower end insertable into the tubular for contact therewith, said body comprising a seal selectively engageable inside the tubular by virtue of moving said body into contact with the tubular;

a gripping member on said body actuable, by moving said body into contact with the tubular, to engage the thread in said tubular to hold said seal in position.

2. The tool of claim 1, wherein:

said gripping member further comprises at least one collet having an exterior surface configured with a thread pattern for selective engagement with the thread in the tubular.

3. The tool of claim 2, further comprising:

a biasing member acting on said collet to urge it toward contact with the thread in the tubular.

4. The tool of claim 3, further comprises:

a ramp assembly on said body, said collet urged by said biasing member along said ramp assembly and toward the thread on the tubular for engagement therewith.

5. The tool of claim 4, wherein:

said collet moves along said ramp assembly and away from the thread on the tubular as said body is inserted into the tubular.

6. The tool of claim 5, wherein:

said biasing member is energized to store a force by movement of said collet along said ramp assembly in a direction away from the thread on the tubular, as said body is inserted into the tubular.

7. The tool of claim 6, wherein:

said ramp assembly comprises at least one first sloping surface and said collet comprises at least one second sloping surface substantially parallel to said first sloping surface.

8. The tool of claim 7, wherein:

said at least one first and second sloping surfaces comprise a plurality of first sloping surfaces with each first sloping surface substantially parallel to another first sloping surface and each second sloping surface parallel to another second sloping surface.

9. The tool of claim 8, wherein:

said biasing member comprises at least one spring.

10. The tool of claim 1, further comprising:

a seal on said body to engage the tubular in a region outside of the thread.

11. The tool of claim 3, wherein:

said biasing member acts on a piston mounted on said body for engagement with the top end of the tubular, said piston supporting a seal for sealing with the tubular.

12. The tool of claim 11, wherein:

said piston extends part way into the tubular beyond the upper end thereof to allow said seal to be inserted into the tubular.

13. The tool of claim 12, wherein:

a ramp assembly on said body, said collet urged by said biasing member along said ramp assembly and toward the thread on the tubular for engagement therewith.

14. The tool of claim 13, wherein:

said collet moves along said ramp assembly and away from the thread on the tubular as said body is inserted into the tubular.

15. The tool of claim 14, wherein:

said biasing member is energized to store a force by movement of said collet along said ramp assembly in a direction away from the thread on the tubular, as said body is inserted into the tubular.

16. The tool of claim 14, wherein:

said body comprises access to said collet for moving said collet along said ramp assembly and away from the threads on the tubular to release said body from engagement with the tubular.

17. The tool of claim 12, wherein:

said piston, when exposed to internal pressure in said passage is subjected to a greater force towards contact with the top end of the tubular.

18. The tool of claim 17, wherein:

said piston transfers a force to said collet, responsive to pressure in said passage, to increase the contact force with the thread on the tubular due to increased downward force on said collet along said ramp assembly.

19. The tool of claim 18, further comprising:

seals adjacent said collet and said piston to prevent fluid leakage from said body when connected to the tubular and subjected to pressure in said passage.

* * * * *